United States Patent [19]

Hashimoto et al.

[11] Patent Number: 5,048,990

[45] Date of Patent: Sep. 17, 1991

[54] WRITING INSTRUMENT WITH DRYING-PREVENTING MECHANISM

[75] Inventors: Yasuyuki Hashimoto; Haruo Yamashita, both of Hyogo, Japan

[73] Assignee: Ancos Co., Ltd., Osaka, Japan

[21] Appl. No.: 117,781

[22] Filed: Nov. 6, 1987

[30] Foreign Application Priority Data

| | | | |
|---|---|---|---|
| Nov. 7, 1986 | [JP] | Japan | 61-264043 |
| Dec. 26, 1986 | [JP] | Japan | 61-308851 |
| Apr. 14, 1987 | [JP] | Japan | 62-89875 |
| May 29, 1987 | [JP] | Japan | 62-131673 |

[51] Int. Cl.[5] ..... B43K 9/00

[52] U.S. Cl. ..... 401/107; 401/108

[58] Field of Search ..... 401/107, 108

[56] References Cited

U.S. PATENT DOCUMENTS

| | | | |
|---|---|---|---|
| 2,035,555 | 3/1936 | Landau | 401/108 |
| 2,092,459 | 9/1937 | Kutter | 401/108 X |
| 2,097,160 | 10/1937 | Locurto | 401/108 |
| 2,240,992 | 5/1941 | Landau | 401/108 |
| 2,401,711 | 6/1946 | Smith | 401/108 |
| 3,292,593 | 12/1966 | Furuya | 401/107 |
| 4,540,300 | 9/1985 | Midorikawa | 401/107 |
| 4,544,297 | 10/1985 | Grossiord | 401/107 X |
| 4,629,348 | 12/1986 | Hashimoto et al. | 401/108 X |

FOREIGN PATENT DOCUMENTS

| | | | |
|---|---|---|---|
| 0121113 | 10/1984 | European Pat. Off. . | |
| 623816 | 12/1935 | Fed. Rep. of Germany | 401/108 |
| 7037517 | 10/1970 | Fed. Rep. of Germany . | |
| 940758 | 12/1948 | France | 401/59 |
| 1419821 | 10/1965 | France | 401/108 |
| 1438554 | 4/1966 | France | 401/108 |
| 469200 | 2/1952 | Italy | 401/108 |
| 470933 | 4/1952 | Italy | 401/107 |
| 2041296 | 9/1980 | United Kingdom | 401/108 |

*Primary Examiner*—Steven A. Bratlie

*Attorney, Agent, or Firm*—Sughrue, Mion, Zinn Macpeak & Seas

[57] ABSTRACT

A cap-less writing instrument having a mechanism which prevents the writing member from drying out. The writing instrument includes a hollow body; a writing member having a writing tip accommodated in the hollow body; a seal for sealing the writing tip, the seal including a seal cylinder provided with an opening at a front end thereof, a cover for sealing the opening of the seal cylinder, and a sealing member provided between the seal cylinder and the writing member; a mechanism for moving the writing member from the writing position to a retracted position; and a connector for connecting the writing member to the cover while allowing the writing member to move the writing position and causing the cover to close the opening of the seal cylinder. The connector is either a thread-like member or a bendable bar-like member.

25 Claims, 20 Drawing Sheets

WRITING INSTRUMENT WITH DRYING-PREVENTING MECHANISM

FIELD OF THE INVENTION

This invention relates to a cap-less writing instrument with a drying preventing mechanism which can readily be used because it has no cap, and which is reliably sealed while not in use with the writing member retracted into the writing instrument body, and which is low in manufacturing cost because it is small in the number of components and simple in structure.

BACKGROUND OF THE INVENTION

Cap-less writing instruments having a writing member which is prevented from drying can be roughly classified into two groups: in the first group, the writing member is prevented from drying by improving the ink or the air hole, and in the second group, a drying preventing mechanism is provided in the writing instrument body. Examples of the writing instrument of the first group are a marking-pen using so-called "non-dry ink", and a ball-point pen using aqueous ink which is difficult to dry and which has a very small air hole at the rear end of the writing member. These types of writing instruments do not have a drying preventing mechanism, and therefore, the writing member is not sufficiently protected from drying. Accordingly, before the writing instrument is presented on the market, the writing member must be wrapped with aluminum foil or the like separately from the writing instrument body. Examples of the writing instrument of the second group are a rotary type writing instrument and a click (retractable) type writing instrument. These writing instruments are intricate in construction and consist of a large number of components and accordingly have high manufacturing costs. Furthermore, these writing instruments are not so sufficiently sealed and therefore cannot be placed on sale with the writing member accommodated in the writing instrument body. Accordingly, a person cannot test the writing instrument before he buys it.

On the other hand, writing instruments which are simple in construction and sufficiently sealed have been proposed in the art. However, these writing instruments are disadvantageous in that, when used, the body has to be maintained substantially horizontal for extracting the writing member and a tip end of the writing member has to be maintained downward for retracting the writing member into the body. In other words, these types of writing instruments require intricate directional operation. Further, they have an unsatisfactory design.

SUMMARY OF THE INVENTION

An object of this invention is to provide a cap-less writing instrument in which the above-described difficulties accompanying a conventional cap-less writing instrument have been eliminated. More specifically, an object of the invention is to provide a cap-less writing instrument which is reliably sealed and can therefore be marketed with the writing member accommodated in the writing instrument body and which has a small number of components and a simple structure and accordingly is low in manufacturing cost and is excellent in design.

The foregoing object of the invention has been achieved by the provision of a cap-less writing instrument comprising a writing member having a writing tip and an air hole accommodated in a writing instrument body; a seal cylinder front end portion of which is formed into a small diameter part disposed inside the writing instrument body; a seal cover for closing the end opening of the seal cylinder disposed on the seal cylinder side or the writing instrument side near the front end of the seal cylinder; a sealing member of elastic material disposed at the rear of the air hole located at the retraction of the writing tip of the writing member into the seal cylinder, in the seal cylinder or in the part of the writing instrument body which is in contact with the rear end of the seal cylinder in such a manner that the sealing member is maintained pressed against a part of the writing member; a writing member moving mechanism disposed between the writing instrument body and the writing member which is turned or knocked to move the writing member forwardly and lock it at a writing position with the writing tip protruded through the front end hole of the writing instrument body and which unlocks the writing member and moves it backwardly by an elastic force of a retracting spring or by rotation to thereby retract the writing tip into the seal cylinder; connecting means including a thread-like member, bar-like member or wire-like member to connect the writing member or a member operating in association with the writing member to the seal cover so that the writing member can move forwardly even after the seal cover has been opened, and after the writing member is retracted, the seal cover is pulled backwardly so as to be brought into close contact with the end of the small diameter part of the seal cylinder and between the writing instrument body and the seal cylinder; means for guiding the thread-like member, bar-like member or wire-like member of the connecting means disposed on the seal cylinder side or on the writing instrument body.

The writing instrument of the invention is constructed as described above. When the writing instrument is not in use, the writing member is retracted into the writing instrument body as in the case where a person carries it with him. Owing to the backward force of the writing member, or the member operating in association with the writing member (which is the force of the retracting spring in the case of the knock type writing instrument, and is the backward force provided by rotation in the case of the rotary type writing instrument), the seal cover is abutted against the front end of the seal cylinder through the connecting means to thereby seal the end opening of the seal cylinder. Furthermore, the sealing member, made of elastic material, is pushed against the part of the writing member on the same section as or at the rear of the air hole of the writing member. Therefore, the writing tip and the air hole of the writing member are completely sealed by the close contact of the seal cover with the end of the seal cylinder and by the abutment of the sealing member against the writing member.

Under this condition, the writing member is moved forwardly by the knocking or turning operation. In this operation, the member operating in association with the writing member is moved forwardly together with the writing member. As a result, the force pulling the seal cover backwardly so as to open the cover is decreased, or a freely openable seal cover to which neither opening nor closing force is applied is pushed by the writing tip or tapered face of the writing tip of the writing member or by the end of the connecting member, so that the seal cover opens the end opening of the seal cylinder. Thereafter, the writing member is further moved forwardly. In this operation, the seal cover is not pushed by the connecting member any more; that is, the thread-like member slackens, the pushing force of the bar-like member or wire-like member is decreased, or the wire-like member slackens while the writing member and the member operating in association with the writing member moves forwardly, and is finally locked at the writing position. Thus, the writing instrument is ready for writing.

After the writing, the writing member and the member operating in association with the writing member, being released by the knocking or turning operation, are released so as to be moved backwardly (by means of the retracting spring in the case of the knock type writing instrument, and by the turning operation in the case of the rotary type writing instrument). In this case, the backward force through the connecting member is not transmitted to the seal cover until the writing tip of the writing member starts retracting into the end hole of the seal cylinder and the seal cover is pulled backwardly by the retracting force of the writing member through the connecting member for the period of time which elapses from the time that the writing tip starts retracting into the end of the seal cylinder until it is completely retracted thereinto. When the writing tip has been retracted into the end hole of the seal cylinder, the seal cover is strongly urged against the end of the seal cylinder, thus sealing the end hole.

The writing member moves backwardly and forwardly against the force of abutment of the sealing member. The force causing the seal cover to rise (or opening the seal cover) is much smaller than the force pulling the seal cover backwardly through the connecting member, and the force opening the seal cover swingably provided may also be small accordingly. Therefore, the seal cover can be smoothly opened and closed as the writing member moves backwardly and forwardly.

DETAILED DESCRIPTION OF THE INVENTION

Preferred embodiments of this invention will be described with reference to the accompanying drawings.

Figure 1:
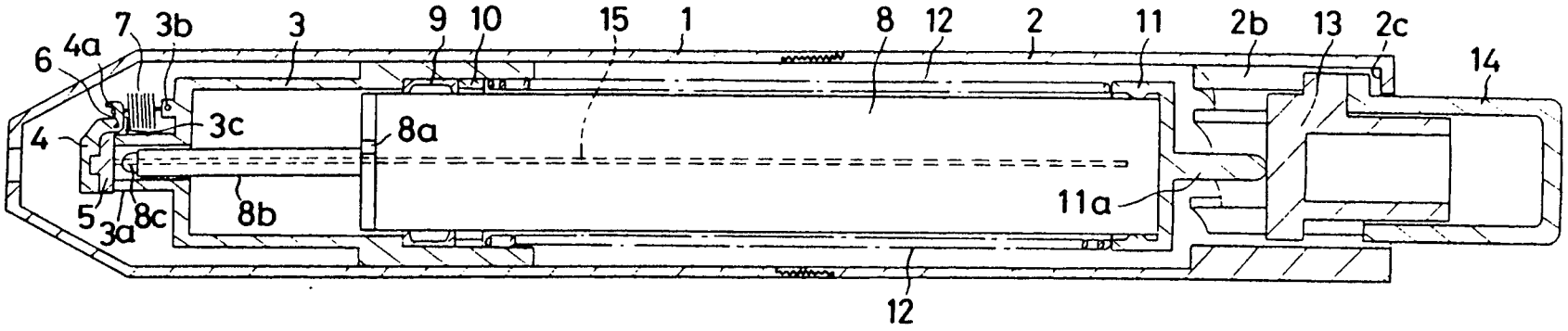
FIG. 1 is a sectional plan view of a first embodiment of a writing instrument according to the present invention.
Figure 2:
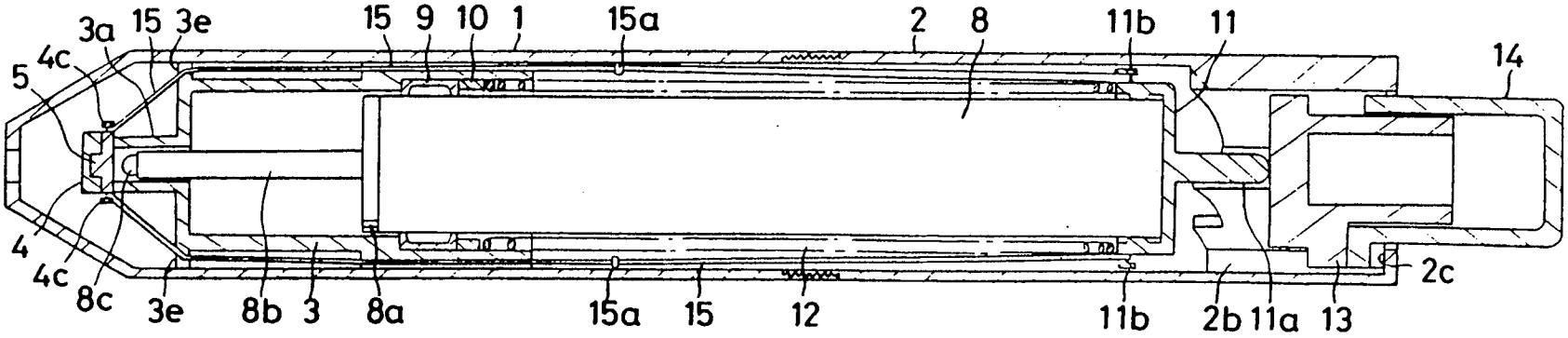
FIG. 2 is a sectional side view of FIG. 1.
Figure 9:
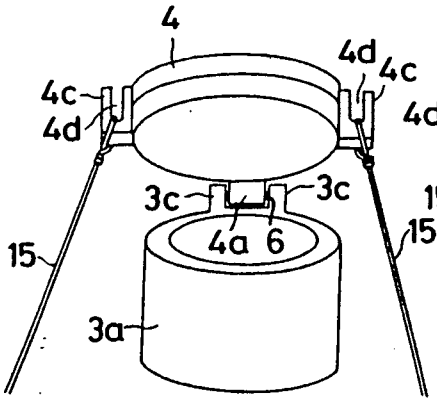
FIG. 9A is an enlarged perspective view showing essential components of seal cover mounting means in the first embodiment of the writing instrument in which a seal cover opens.
FIG. 9B is the same as FIG. 9A except that the seal cover closes.
Figure 9:
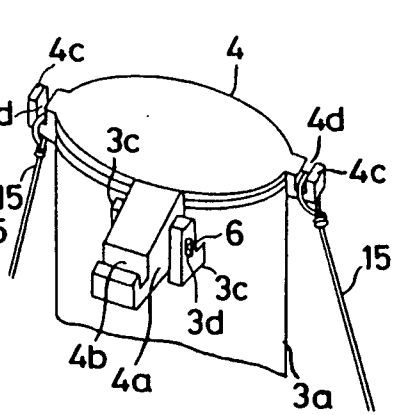

FIGS. 1 and 2 are sectional plan view and a sectional side view showing a first embodiment of a writing instrument according to the invention, respectively. Both FIGS. 1 and 2 show the writing instrument which is sealed with a writing member accommodated in a writing instrument body. A front holder 1 and a rear holder 2 are threadably engaged with each other to form the writing instrument body (hereinafter referred to as "a body", when applicable). A seal cylinder 3 having a small diameter part 3*a* protruded forwardly from one end face is inserted into the front holder 1 and fixedly secured thereto with adhesive or is press-fitted into the front holder 1. The seal cylinder 3 has a protrusion 3*b* on a shoulder thereof. The protrusion 3*b* has a hole at its center. Two ears 3*c* and 3*c* are formed on the front end portion of the small diameter part 3*a* in such a manner that they are flush with the protrusion 3*b*, as shown in FIG. 9. Elliptic holes 3*d* and 3*d*, which are elongated in the axial direction are formed in the ears 3*c* and 3*c*, respectively.

The writing instrument further comprises a seal cover 4. The seal cover 4 is integrally provided with an elastic member 5 at the rear face thereof. However, it is not always necessary to provide the elastic member 5. That is, the elastic member 5 may be eliminated by forming the seal cover 4 of elastic material or by placing an elastic part on the end of the small diameter part 3*a* of the seal cylinder 3 or by forming the small diameter part 3*a* of elastic material.

Referring again to FIG. 9, the seal cover 4 has a leg 4*a* having a round through-hole formed therein to engage the seal cover 4 with the small diameter part 3*a* of the cylinder 3. That is, the leg 4*a* of the seal cover 4 is inserted between the ears 3*c* and 3*c*, and a pin 6 is inserted into the round through-hole of the leg 4*a* and the holes 3*d* and 3*d* of the ears 3*c* and 3*c*. A groove 4*b* is formed in the end portion of the leg 4*a* of the seal cover 4. As described above, the pin 6 is inserted into the round through-hole of the leg 4*a* of the seal cover 4 and the elongated elliptic holes 3*d* of the ears 3*c* so that the seal cover 4 is freely pivotable about the pin 6. Referring to FIGS. 1 and 2, one end portion of an extension spring 7 is engaged with the groove 4*b* of the seal cover's leg 4*a* and the other end portion is engaged with the hole in the protrusion 3*b* formed on the shoulder of the seal cylinder 3 so that the seal cover 4 can be rotated away from the end of the seal cylinder's small diameter part 3*a*. The force of the extension spring 7 may be weak and can merely open the seal cover 4 together with the elastic member 5.

The reason why the holes 3*d* and 3*d* formed in the two ears 3*c* and 3*c* are elliptical is that, when the seal cover 4 is pulled to close the opening of the small diameter part 3*a* of the seal cylinder 3, the elastic member 5 on the seal cover 4 is automatically brought into contact with the front end face of the seal cylinder's small diameter part 3*a* in such a manner that it is in parallel with the front end face thereof. Therefore, instead of the elongated elliptic holes, round holes may be employed if they are so designed to allow the seal cover 4 to be positively abutted against the end face of the small diameter part 3*a* through the elastic member 5. That is, any loose through-holes may be used instead of the elongated elliptic holes.

A seal member 9 of elastic material is fitted on the inner peripheral surface of the seal cylinder 3 at the rear side of an air hole 8*a* (on the right-handed side of the air hole 8*a* in the figures) of the writing member 8, and a retaining ring 10 for preventing the seal member from coming off is fixedly provided at the rear side of the seal member 9. The ring 10 may be eliminated if the seal member 9 is positively held in the seal cylinder 3. The seal member 9 shown in the drawing is annular; however, the configuration of the seal member 9 is not limited to that shown in FIGS. 1 and 2. For instance, the seal member may be U-shaped in section or may be an O-ring. However, the inside diameter of the inner wall of the seal member 9 which is brought into contact with the writing member 8 should be slightly smaller than the outside diameter of the writing member 8.

The front end portion of the writing member 8 includes a small diameter part 8*b* and a writing tip 8*c* slightly protruding therefrom. The air hole 8*a* may be provided in the vicinity of the front end of the small diameter part 8*b* of the writing member 8, instead of the position shown in the figures. The rear end portion of the writing member 8 is retained by a cylindrical receiving part 11 from the center of which a leg 11*a* protrudes rearwardly. A retracting spring 12 is provided between the front end face of the cylindrical receiving part 11 and the seal member retaining ring 10 so as to always urge the writing member 8 rearwardly (to the right in FIGS. 1 and 2) through the receiving part 11. In this case, the receiving part 11 receives one end of the retracting spring 12 and, at the same time, receives the writing member 8. The elastic force of the retracting spring 12 is much larger than that of the extension spring 7 adapted to open the seal cover 4 so that the writing member 8 is urged rearwardly. The rear end of the leg 11*a* of the receiving part 11 is round so that the leg can slide smoothly on a rotary cam 13.

The rear end portion of the rotary cam 13 engages with a pushing member 14. The front end face of the pushing member 14 is a cam surface which engages with the rear end cam surface of the rotary cam 13. The rear end portion of the pushing member 14 is protruded out of the rear holder 2, thus serving as a knock bar. There is a gap between a step 2*c* formed at the rear end of the rear holder 2 and the rear end face of the head of the pushing member 14 because the receiving part 11 is connected to the seal cover 4 so as to prevent its further backward movement. This will improve the sealability of the seal cover 4 against the end of the seal cylinder 3 since the gap allows the receiving part 11 to move backwardly as necessary to absorb any slack in the thread-like members 15 due to expansion thereof to maintain the cover closed tightly. Accordingly, the rotary cam 13 abuts against the leg 11*a* of the receiving part 11 by its own weight, and similarly the pushing member 14 abuts against the rotary cam 13 by its own weight. In this case, the aforementioned slight gap is formed between the rear end step 2*c* of the rear holder 2 and the rear end face of the head of the pushing member 14. This gap acts to absorb the expansion of thread-like members 15 even if the expansion is very small. The receiving part 11 may be made annular having a central aperture. In this case, the front surface receives the retracting spring 12 and the rear surface contacts with the step of the writing member 8 or with a protrusion or the like. In this condition, the receiving part may not be required to grip the writing member 8 since the writing member 8 is prevented from coming off by the rotary cam 13.

FIG. 2 is a sectional side view of the writing instrument shown in FIG. 1. The seal cover 4 has two protrusions 4*c* and 4*c* in which grooves 4*d* and 4*d* are formed at the middle portion, respectively as also shown in FIG. 9. The seal cylinder 3 has protrusions 3*e* and 3*e* in which small holes are formed, respectively. The protrusions 3*e* and 3*d* protrude in the same direction as the protrusions 4*c* and 4*c* of the seal cover 4. Furthermore, small holes are formed in the rear end portion, or the large diameter part, of the seal cylinder. The receiving part 11 has protrusions 11*b* and 11*b* at its front end which are extended in the same direction as the protrusions 3*e* and 3*e* of the seal cylinder 3. A groove is formed in the rear end surface of each of the protrusions 11*b* and 11*b* at the middle thereof.

Under this condition, a first end of two thread-like members 15 and 15 are tied to the grooves 4*d* and 4*d* in the protrusions 4*c* and 4*c* of the seal cover 4, respectively, and the other end of the two thread-like members 15 and 15 are passed through the holes in the protrusions 3*e* and 3*e* of the seal cylinder 3 and the holes in the large diameter part of the seal cylinder and tied to the grooves in the protrusions 11*b* and 11*b* of the receiving part 11, respectively, in such a manner that the thread-like members 15 and 15 are stretched tight as shown in FIG. 2.

In the above-described writing instrument, two thread-like members 15 are used. However, the number of thread-like members 15 may be reduced to one. In this case, the protrusions 4*c* and 4*c* would be eliminated from the seal cover, and instead a groove would be formed in the top surface of th seal cover and the middle of one thread-like member 15 would be engaged with the groove thus formed. Alternatively, one thread-like member may be passed through a hole formed in the seal cover. In case of employing an annular receiving part, rear ends of the thread-like member would be connected to protrusions provided on the receiving part 11 so that the receiving part would be prevented from further moving backwardly.

As is apparent from FIGS. 1 and 2, with the writing member 8 accommodated in the body, the retracting spring 12 having strong elastic force causes the elastic member 5 secured to the seal cover 4 to close the opening of the seal cylinder's small diameter part 3*a* against the elastic force of the extension spring 7 (adapted to merely open the seal cover) with the aid of the thread-like members 15 and 15. On the other hand, behind the air hole 8*a* of the writing member 8 (on the right-handed side of the air hole 8*a* in the figures) the seal member 9 elastically abuts against the cylindrical outer wall of the writing member 8. Thus, the writing tip 8*c* and the air hole 8*a* are sealingly held in the seal cylinder 3.

Figure 3:
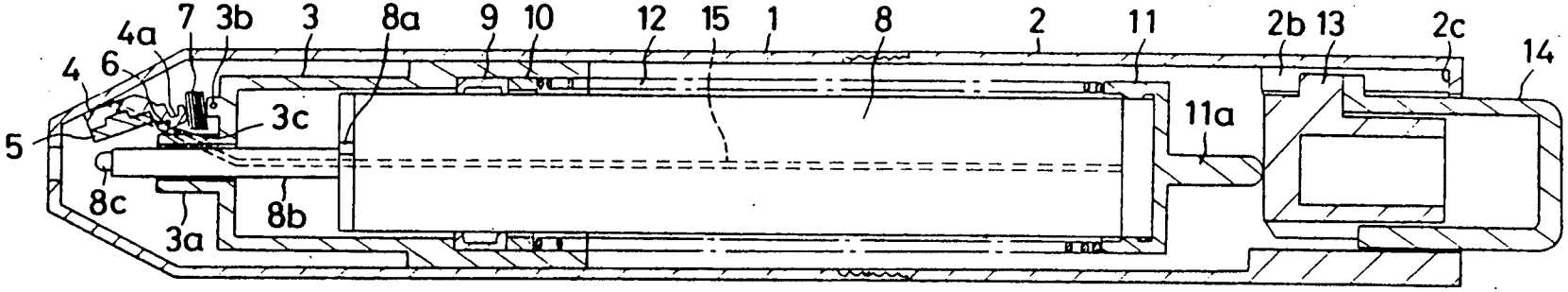
FIGS. 3, 5 and 7 are sectional plan views for a description of the operation of the writing member of the first embodiment of the writing instrument.
Figure 4:
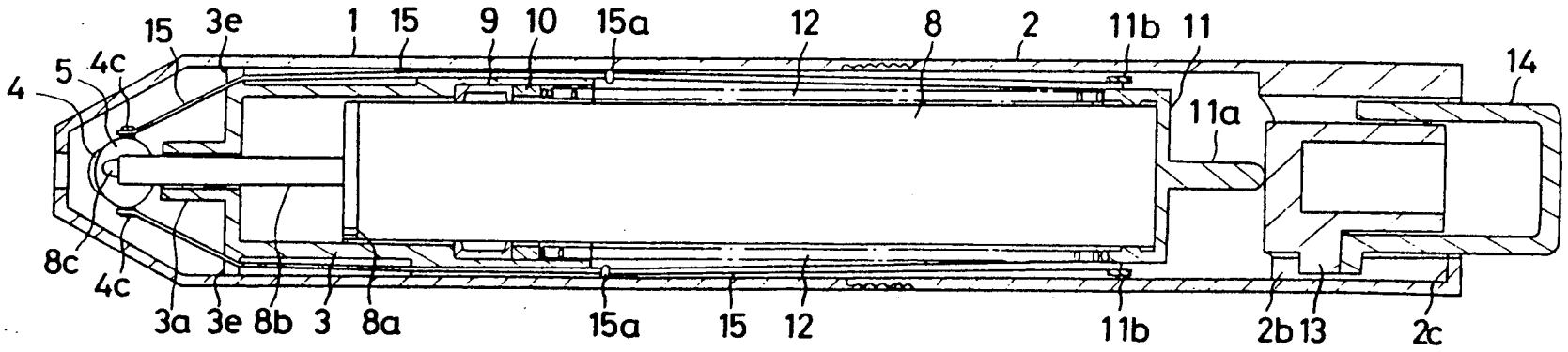
FIGS. 4. 6 and 8 are sectional side views of FIGS. 3, 5 and 7, respectively.

FIGS. 3 and 4 show the writing instrument in which the protruded part of the pushing member 14, namely, the knock bar is pushed until the seal cover is completely opened. As is apparent from FIGS. 3 and 4, as the knock bar is moved forwardly, so that the receiving part 11 is moved forwardly through its leg 11*a* while the retracting spring 12 is being compressed. Accordingly, the thread-like member 15 and 15 slacken; however, since the seal cover 4 is opened by the elastic force of the extension spring 7, the thread-like members are pulled forwardly as much as they slacken. As a result, knots 15*a* and 15*a* formed at the middles of the thread-like members 15 and 15, respectively, are caused to move near the rear ends of the holes formed in the large diameter part of the seal cylinder 3, respectively. Thus, the knots 15*a* and 15*a* serve as a kind of stoppers to prevent the thread-like members 15 and 15 from slackening in front of the seal cylinder 3. The knots 15*a* and 15*a* may be eliminated if applicable. The seal cover 4 thus opened is held abutted against the inner surface of the tapered end portion of the front holder 1.

Figure 5:
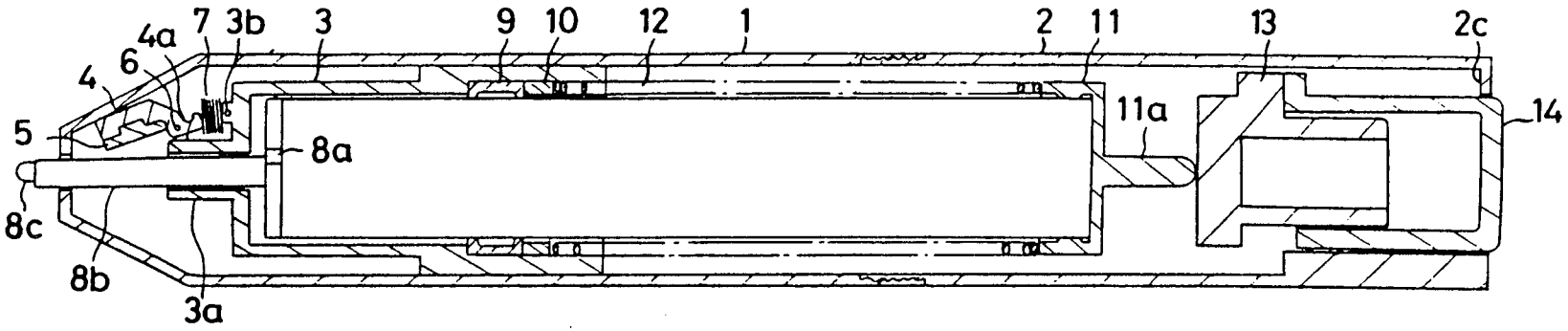
Figure 6:
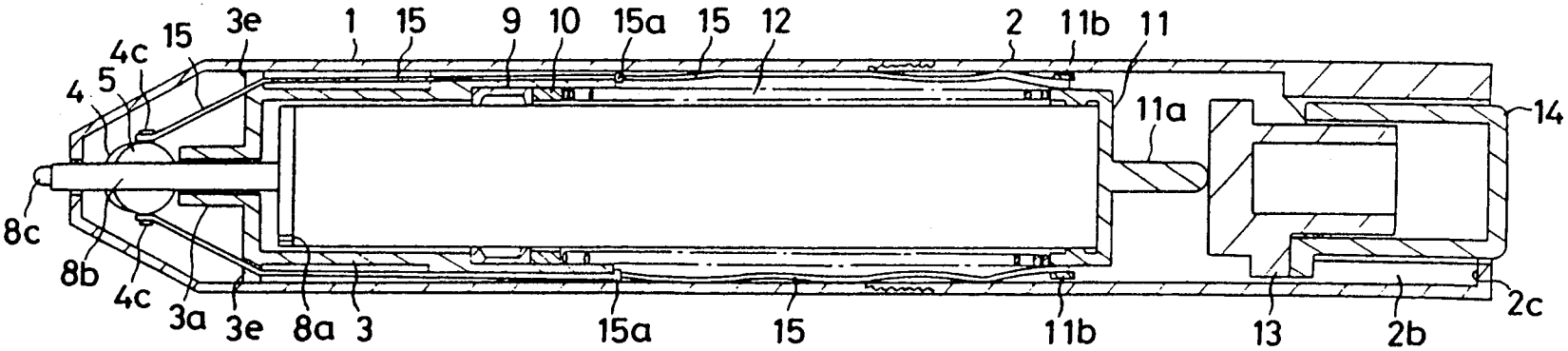

FIGS. 5 and 6 show the writing instrument in which the knock bar has been fully pushed. FIGS. 5 and 6 are a sectional plan view and a sectional side view of the writing instrument, respectively. As shown in FIGS. 5 and 6, the retracting spring 12 is further compressed and the rotary cam 13 is moved to a position where it is rotatable in the cam cylinder. In this case, since the seal cover 4 has been fully opened, the state of the seal cover 4 shown in FIGS. 5 and 6 is the same as that of the seal cover shown in FIGS. 3 and 4; however, the writing member 8 is further moved forwardly while the thread-like members 15 and 15 slacken, and the writing tip 8*c* is protruded out of the front end face of the front holder 1 through a hole formed therein. The knots 15*a* and 15*a* are abutted against the rear ends of the holes in the seal cylinder's large diameter part by their own weight. Therefore, the thread-like members 15 and 15 are not slackened in front of the seal cylinder 3, but they are slackened in the rear side thereof.

Figure 7:
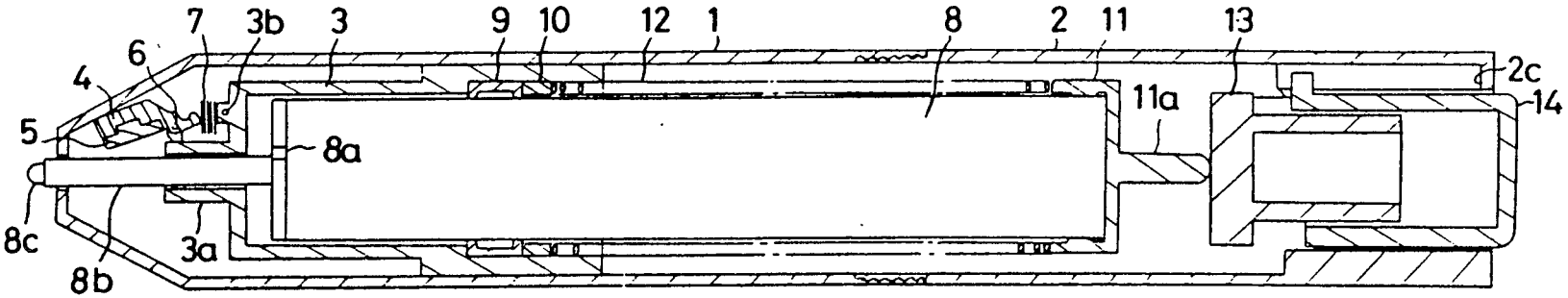
Figure 8:
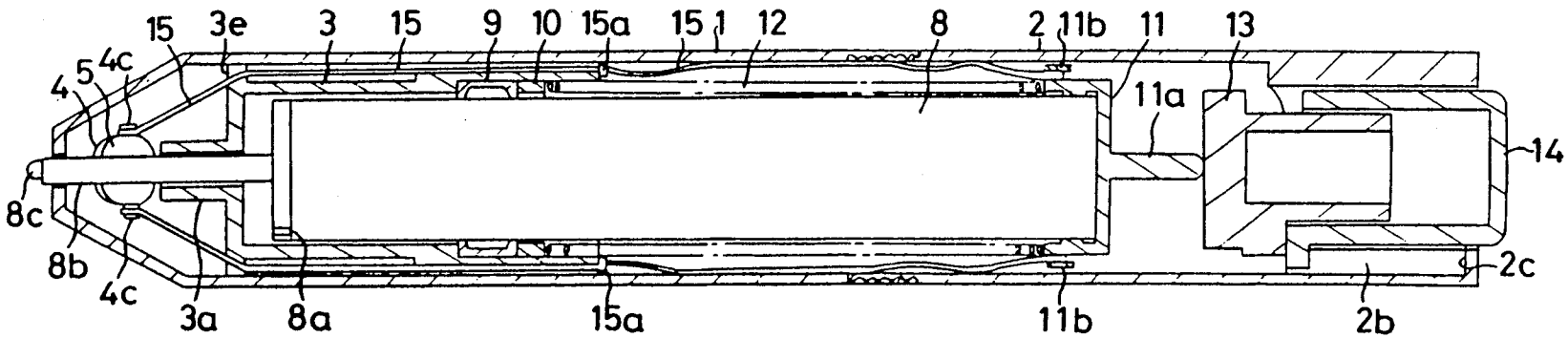

FIGS. 7 and 8 show the writing instrument in which the writing tip 8*c* is held at the writing position with the knock bar released in FIGS. 5 and 6. FIGS. 7 and 8 are different from FIGS. 5 and 6 in that the rotary cam 13 is locked at the advance position in the cam groove 2*b*, and accordingly, the writing member 8 is locked at the writing position with the aid of the receiving part 11. That is, in FIGS. 7 and 8, the pushing member 14, the rotary cam 13, the receiving part 11 and the writing member 8 move slightly backwardly when compared with those in FIGS. 5 and 6. Under this condition, the writing instrument can be used for writing.

After the writing, the knock bar is fully depressed, as a result of which the state as shown in FIGS. 5 and 6 is obtained. When, under this condition, the knock bar is released, the state as shown in FIGS. 3 and 4 is obtained and then the state as shown in FIGS. 1 and 2 is obtained. The writing member 8 is accommodated in the body, and the writing tip 8*c* and the air hole 8*a* are sealingly held in the seal cylinder 3. The writing member 8 advances and retracts by the force of the knocking operation and the elastic force of the retracting spring, respectively against the frictional resistance between the seal member 9 and the writing member 8.

FIGS. 9A and 9B are enlarged perspective views showing a part of the writing instrument in which, with the leg 4a of the seal cover 4 held between the two ears 3c and 3c of the small diameter part 3a of the seal cylinder 3, the pin 6 is inserted therein to couple the seal cover 4 to the front end of the seal cylinder's small diameter part 3a. and the end portions of the thread-like members 15 and 15 are tied to the grooves 4d and 4d of the protrusions 4c and 4c of the seal cover 4. More specifically. FIG. 9A is a perspective front view showing the seal cover 4 slightly opened, and FIG. 9B is a perspective rear view showing the seal cover 4 closed.

In FIG. 2, the small holes in the protrusions 3e and 3e formed on the shoulder of the seal cylinder 3 and the small holes formed in the large diameter part of the seal cylinder 3 may be replaced by grooves, respectively. In this modification, the thread-like members 15 and 15 can engage with the grooves with ease.

Figure 10:
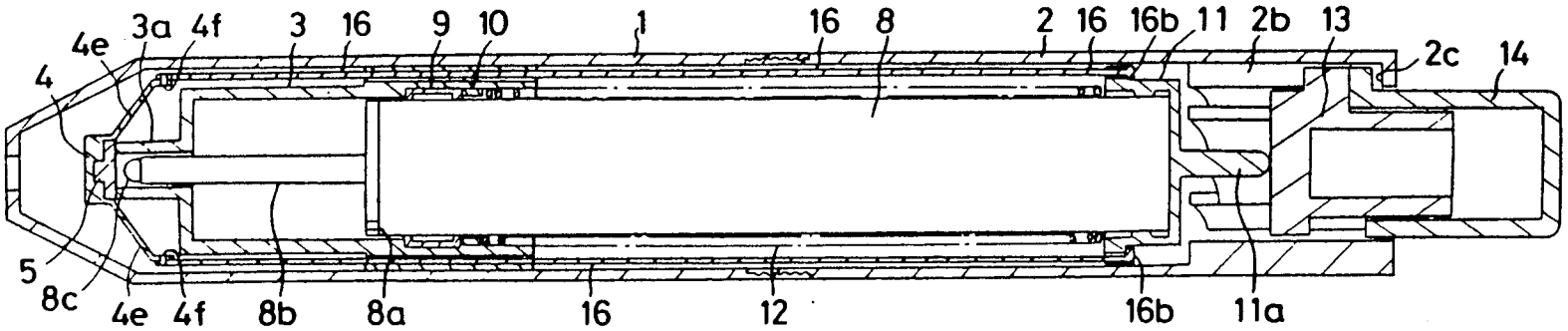
FIG. 10 and 12 are sectional side views showing different operational states of a second embodiment of the writing instrument according to the present invention.
Figure 11:
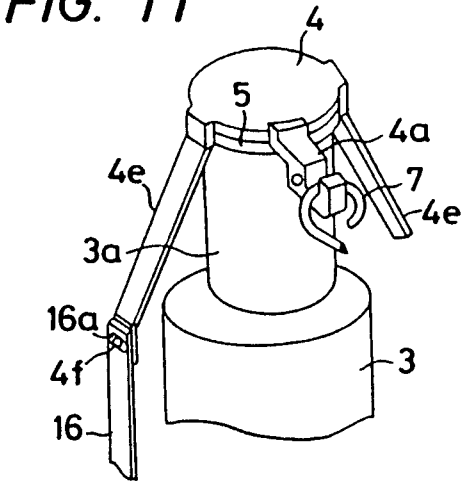
FIG. 11 is an enlarged perspective view showing a seal cover closed in the second embodiment of the writing instrument according to the present invention.
Figure 12:
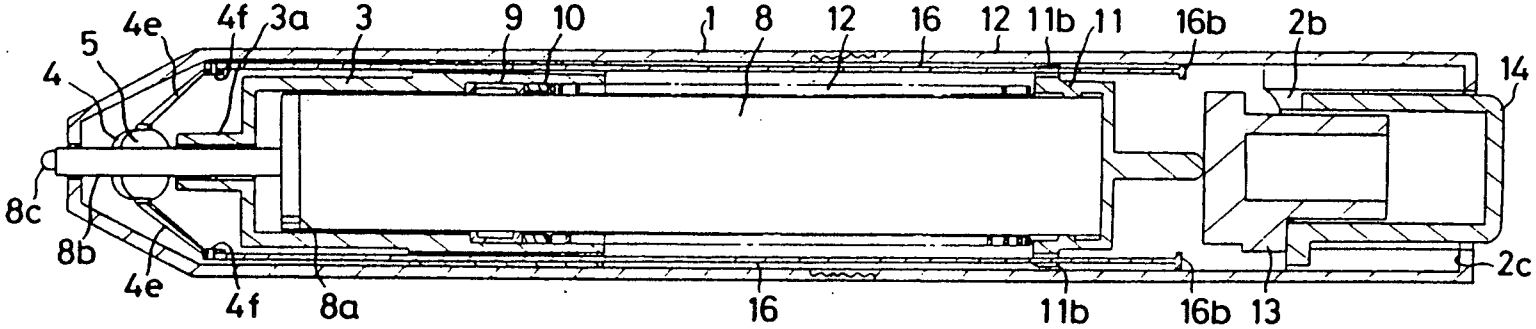

FIGS. 10 and 12 are sectional side views showing a second embodiment of the writing instrument according to the invention, corresponding to FIGS. 2 and 8, respectively. That is. FIG. 10 shows the writing instrument in which the writing member is accommodated in the body and the seal cover 4 seals the seal cylinder 4. FIG. 12 shows the writing instrument in which the writing tip is held at the writing position. Sectional plan views of the second example corresponding to FIGS. 1 and 7 are not provided because they are the same as those in the first embodiment of the writing instrument. FIG. 11 is an enlarged perspective view showing essential components of the second embodiment of the writing instrument in which the seal cover closes.

The second embodiment is different from the first embodiment in that instead of the thread-like members, bar-like members (which is not limited in sectional configuration—the section may be circular, rectangular, polygonal or semicircular are provided. Therefor, in FIGS. 10, 11 and 12, those components which have been previously described with reference to the first embodiment of the writing instrument are therefore designated by the same reference numerals or characters.

Two arms 4e and 4e are extended from the parts of the seal cover 4 which are located about 90° apart from the seal cover's leg 4a. Each of the arms 4e is in the form of an elongated plate. The arms 4e diverge towards the peripheral of the shoulder of the seal cylinder 3 and extend in parallel with the seal cylinder 3. The arms 4e have protrusions 4f and 4f on the end portions, respectively and are circular in section. The protrusions 4f and 4f are engaged with laterally elongated elliptic holes 16a and 16a formed in bar-like members 16 and 16 which are in the form of a belt-shaped plate similarly as in the arms 4e, respectively, in such a manner that the arms and the bar-like members are bendable at the connecting points, respectively. Instead of the protrusions 4f and 4f, small holes may be formed so that, as in the first embodiment, the arms may be coupled to the bar-like members with pins. The holes 16a are not limited in configuration. That is, any loose through-holes may be employed.

Through-holes large enough for the bar-like members 16 and 16 to pass are formed in the large diameter part of the seal cylinder 3 and the front end flange of the receiving part 11. After the bar-like members 16 and 16 are passed through these holes, stoppers 16b and 16b are formed on the end portions of the bar-like members 16 and 16, respectively. Owing to the provision of the stoppers 16b and 16b, the elastic member 5 secured to the seal cover 4 is abutted against the front end of the small diameter part of the seal cylinder 3 through the bar-like members 16 and 16 and the arms 4e and 4e by the elastic force of the retracting spring 12 in the case of FIG. 10. And in the case of FIG. 12, after the seal cover 4 is opened, the receiving part 11 moves forwardly while compressing the retracting spring 12; however, the bar-like members 16 and 16 are not pushed by the receiving part 11; that is, the receiving part 11 and the writing member 8 are moved forwardly leaving the stoppers 16b and 16b.

In the second embodiment of the writing instrument, the number of bar-like members may be reduced to one. In the modification, an arm having a U-shaped head is bendably coupled to the end of one bar-like member, and the seal cover is pivotably coupled to both ends of the U-shaped head.

The second embodiment of the writing instrument operates substantially in the same manner as the first embodiment. However, it should be noted that since the bar-like members 16, unlike the thread-like members, will never slacken, the second embodiment is so designed that the stoppers 16b are formed on the rear end portions of the bar-like members 16 so that they abut against the rear end face of the flange of the receiving part 11, and the receiving part 11 can move forwardly in front of the stoppers 16b.

The loose through-holes formed in the end portions of the bar-like members 16 can absorb the slight lateral movement of the bar-like members which, otherwise, may be caused when the arms 4e and 4e pivot to open and close the seal cover 4.

In the knock type writing instrument as described above, the writing member advances by the knocking force and retracts by the elastic force of the retracting spring. On the other hand, in case of the rotary type, the retracting spring may be eliminated since the writing member advances and retracts by the rotating operation.

Further, in the knock type writing instrument, the receiving part may be eliminated if the rear end of the retracting spring abuts directly against a step or a protrusion or the like of the writing member. In this case, the rear ends of the thread-like members are directly connected to a part of the writing member, or stoppers of the bar-like members are connected to the part of the writing member. That is, the receiving member for the retracting spring and the connecting portions of the thread-like members may be the same portion or different portion. Further, the rear end of the writing member may act as a pushing member. In this arrangement, the writing member is locked to its advance position and released to a retract position by knocking the writing member itself.

Now, a third embodiment of the invention will be described.

Figure 13:
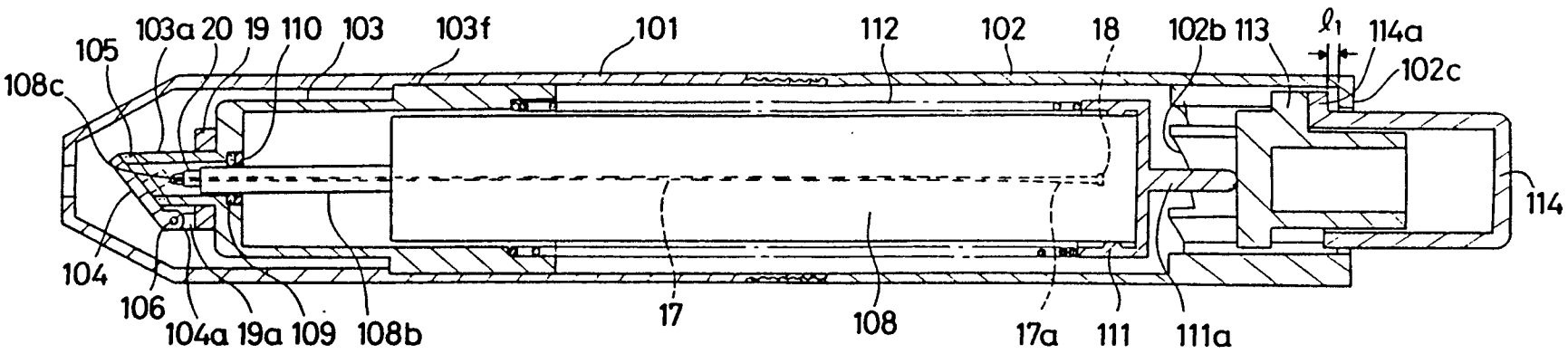
FIG. 13 is a sectional plan view of a third embodiment of the writing instrument according to the present invention.
Figure 14:
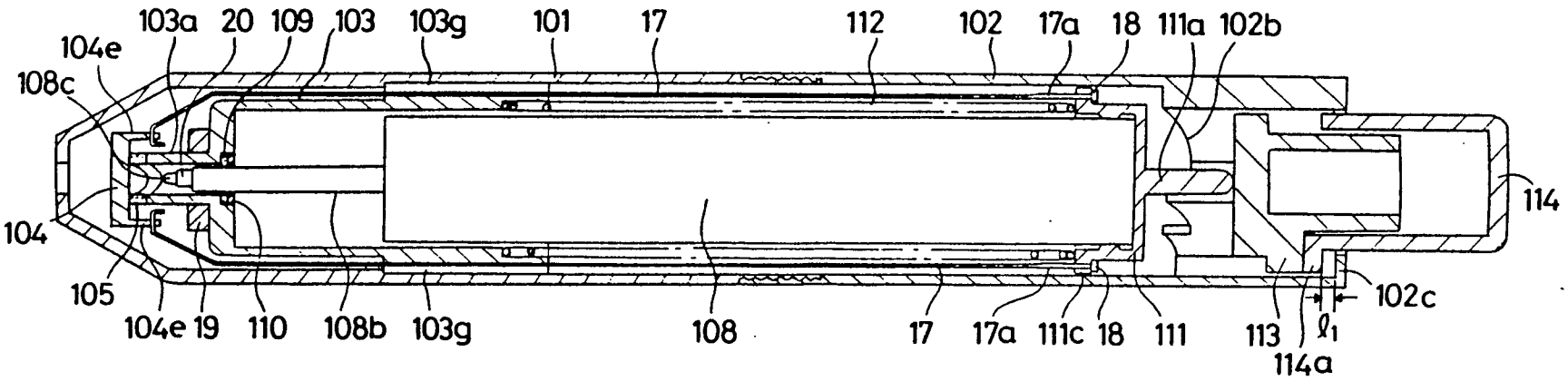
FIG. 14 is a sectional side view of FIG. 13.
Figure 15:
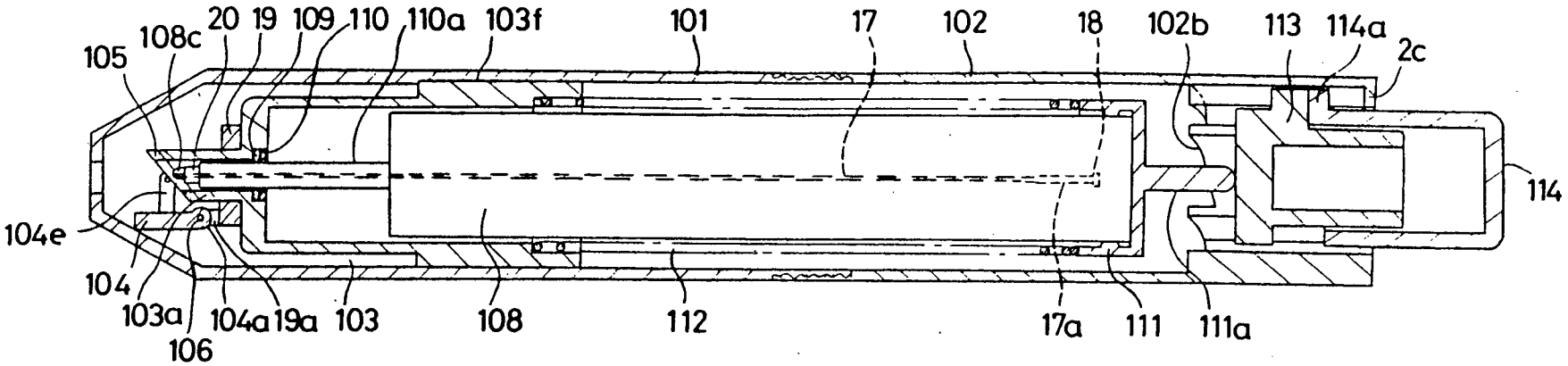
FIG. 15 is a sectional plan view of the writing instrument in which a seal cover opens with a knocking member pushed slightly.
Figure 16:
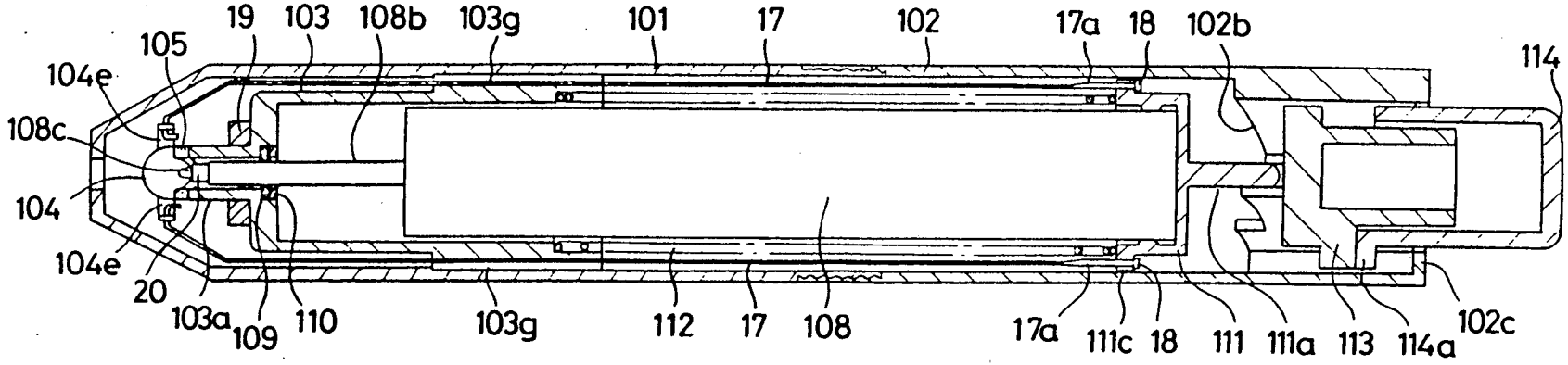
FIG. 16 is a sectional side view of FIG. 15.
Figure 17:
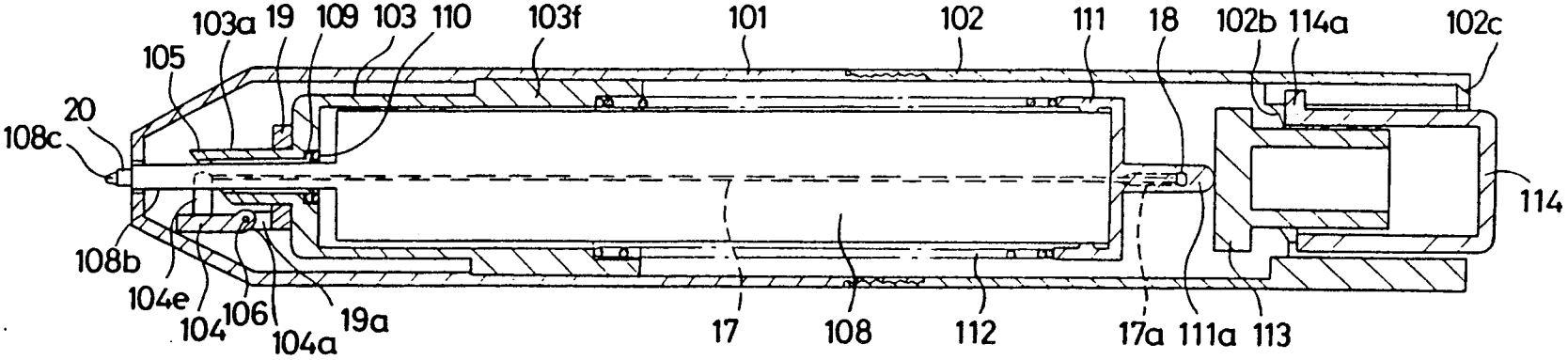
FIG. 17 is a sectional plan view of the writing instrument which is made ready for writing with the knocking member pushed fully to an end and released.
Figure 18:
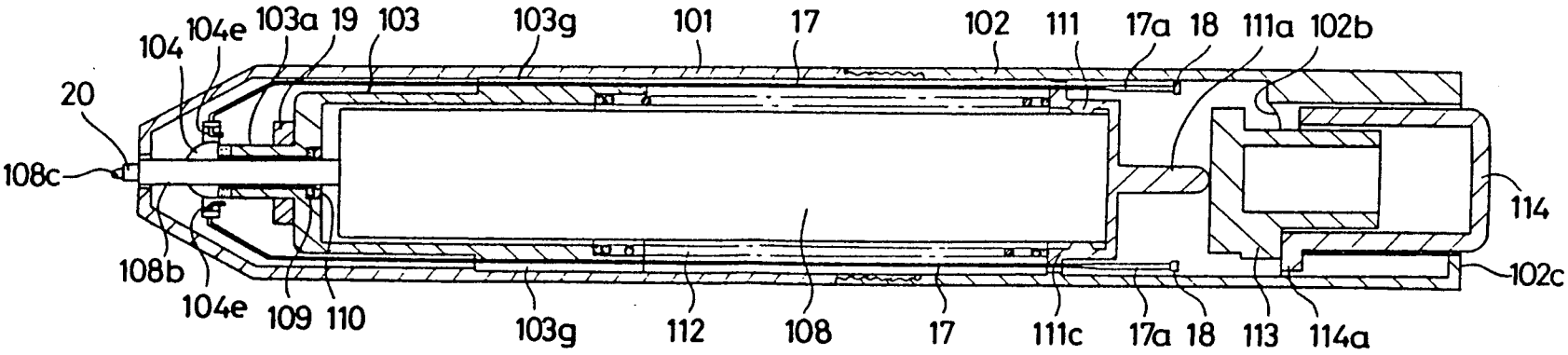
FIG. 18 is a sectional side view of FIG. 17.

FIGS. 13 and 14 are sectional plan view and a sectional side view of the writing instrument in which the writing member has been retracted, respectively. FIGS. 15 and 16 are sectional plan view and a sectional side view showing the writing instrument in which the writing member is moved forwardly to open its seal cover, respectively. FIGS. 17 and 18 are sectional plan view and a sectional side view showing the writing instrument which is ready for writing, respectively. FIG. 9 is an enlarged perspective view showing essential components of the writing instrument.

In the third embodiment, the seal cover 104 is connected to the writing member 108 or the member 111 operated in association with the writing member 108 through wire-like members (or bark-like members) 17 which are substantially thin, strong and rigid. Each of the wire-like members has a frictional part 17*a* which provides frictional resistance between the wire-like member 17 and the writing member 108 or the member 111 operating in association with the writing member 108 in the initial period of the forward movement of the writing member 108; i.e., until the seal cover opens. The wire-like members 17 have stoppers 18 at the rear end thereof.

Figure 19:
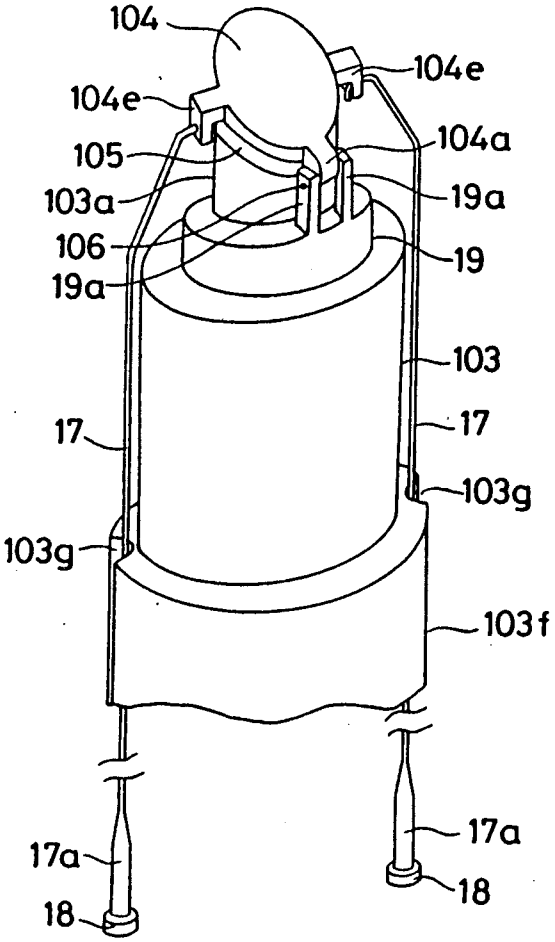
FIG. 19 is an enlarged perspective view showing essential components of the third embodiment of the present invention.

In FIGS. 13 through 19, reference numeral 101 designates a front holder; and 102, a rear holder having a cam groove 102*b*. The front and rear holders 101 and 102 are threadably engaged with each other to form a writing instrument body. The large diameter part 103*f* of a seal cylinder 103 is press-fitted into the front holder 101. The large diameter part 103*f* has grooves 103*g* and 103*g* into which the wire-like members 17 and 17 are inserted while being guided, respectively. The front end portion of the small diameter part 103*a* of the seal cylinder 103 is obliquely cut so that the small diameter part 103*a* has an elliptic opening at the end. An elastic member 105 similar in configuration to the elliptic part 103*a*. The aforementioned seal cover 104 is large enough to cover the elliptic opening of the small diameter part 103*a* of the seal cylinder 103, and has a leg 104*a*. The leg 104*a* is held between two arms 19*a* and 19*a* of a hinge seat 19, and a pin 106 is inserted into the leg 104*a* and the arms 19*a* and 19*a* so that the seal cover 104 can pivot about the pin 106, as shown in FIG. 19. A sealing O-ring 109 is fitted in the rear end portion of the small diameter part 103*a* of the seal cylinder 103 and is retained with a retaining ring press-fitted therein.

Figure 25:
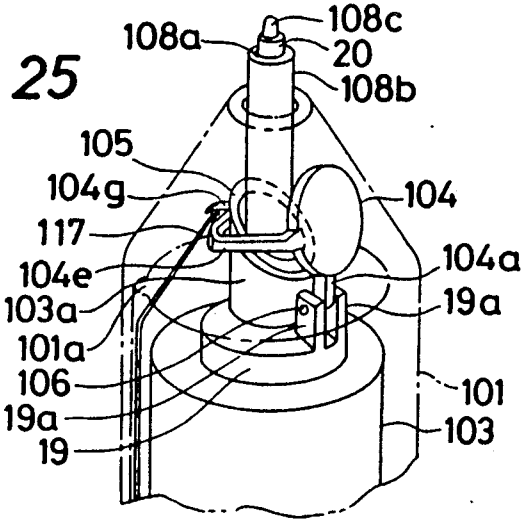
FIG. 25 is an enlarged perspective view showing essential components of the writing instrument shown in FIG. 23.

A holding part 20 adapted to hold a writing tip 108*c* is press-fitted into the small diameter part 108*b* of the writing member 108, and the writing tip 108*c* is slightly protruded from the holding part 20. An air hole 108*a* is provided between the holding part 20 and the writing member's small diameter part 108*b* as shown in FIG. 25.

The front end portions of the wire-like members 17 and 17 are fixedly engaged with the holes which are formed in the rear end portions of the arms 104*e* and 104*e* of the seal cover 104, respectively. Under this condition, the wire-like members 17 and 17 are made divergent and inserted into the grooves 103*g* and 103*g* of the large diameter part 103*f* of the seal cylinder 103 and then into grooves formed in the receiving member 111, respectively. Under this condition, the stoppers 18 and 18 are connected to the rear ends of the wire-like members 17 and 17, respectively. A retracting spring 112 is disposed between the seal cylinder 103 and the receiving member 111. The rear end portion of each of the wire-like members, which is located in the groove 111*c* of the receiving member 111 and is extended slightly forwardly of the groove, is formed into the aforementioned frictional part 17*a* which provides frictional resistance between the wire-like member 17 and the groove 111*c* of the receiving member 111. The frictional parts 17*a* and 17*a* may be formed by increasing the diameters of the rear end portions of the wire-like members 17 and 17*a*, by deforming the rear end portions, or by putting thin-wall pipes on the rear end portions, respectively.

In the case of FIGS. 13 and 14, the swingable seal cover 104 is maintained pulled backwardly by the wire-like members 17 and 17, and the receiving member 111 is prevented from moving backward any further due to the presence of the stoppers 18 and 18. Therefore, there is a gap $l_1$ between the rear holder's rear end step 102*c* and the head 114*a* of a pushing member 114 which abuts against the rotary cam 113 by its own weight which also abuts against the leg 111*a* of the receiving member 111 by its own weight. That is, the seal cover 104 is brought into close contact with the elastic member 105 by the force of the retracting spring 112. On the other hand, the sealing O-ring 109 is pushed against the small diameter part 108*b* of the writing member 108 at the rear of the air hole 108*a*, and therefore, the writing tip 108*c* and the air hole 108*a* of the writing member 108 are sealed in the seal cylinder.

FIGS. 15 and 16 show the writing instrument in which the seal cover 104 opens with the knocking member 114 pushed slightly.

As the receiving member 111 moves forwardly, the wire-like members 17 and 17 also move forwardly against the frictional resistance, and therefore, the seal cover 104 coupled to the wire-like member 17 and 17 open.

FIGS. 17 and 18 show the writing instrument prepared for writing with the knocking member 114 pushed fully to the end and released. Under this condition, the frictional parts 17*a* and 17*a* of the wire-like members 17 and 17 disengage from the grooves in the flange 111*c* of the receiving member 111. Accordingly, even when the receiving member 111 moves forwardly, the seal cover 104 will not move from the position shown in FIGS. 15 and 16. Therefore, the writing member 108 moves forwardly together with the receiving member 111 and is locked so as to make the writing instrument ready for writing.

When the knocking member 111 of the writing instrument which is in a state as shown in FIGS. 17 and 18 is pushed fully and released, the writing instrument is placed in a state shown in FIGS. 15 and 16 and then in a state as shown in FIGS. 13 and 14.

FIG. 19 is an enlarged perspective view showing essential components of the third embodiment of the invention, as was described above.

Figure 20:
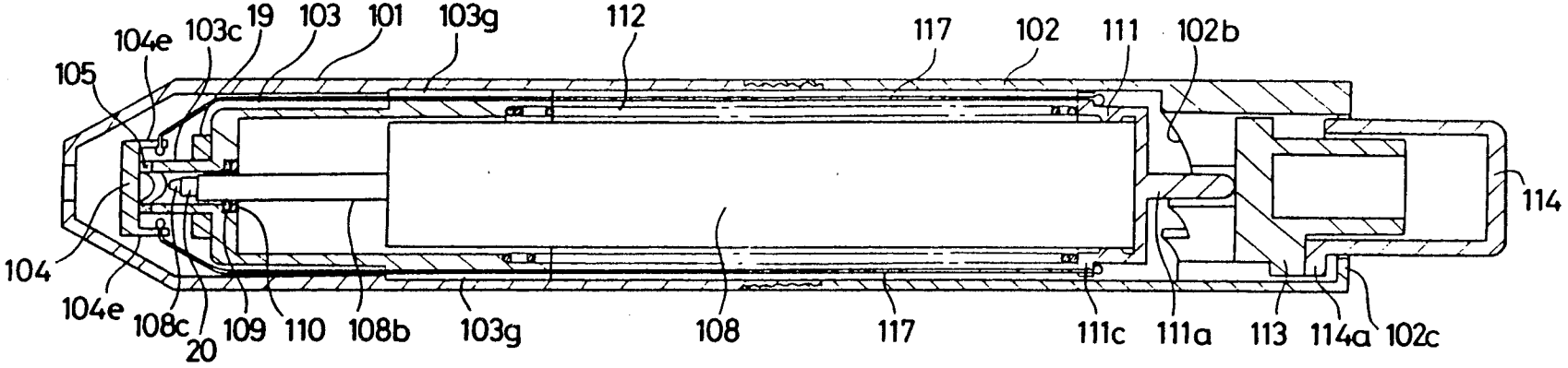
FIG. 20 is a sectional plan view of a fourth embodiment of the writing instrument according to the invention, which is in seal state.
Figure 21:
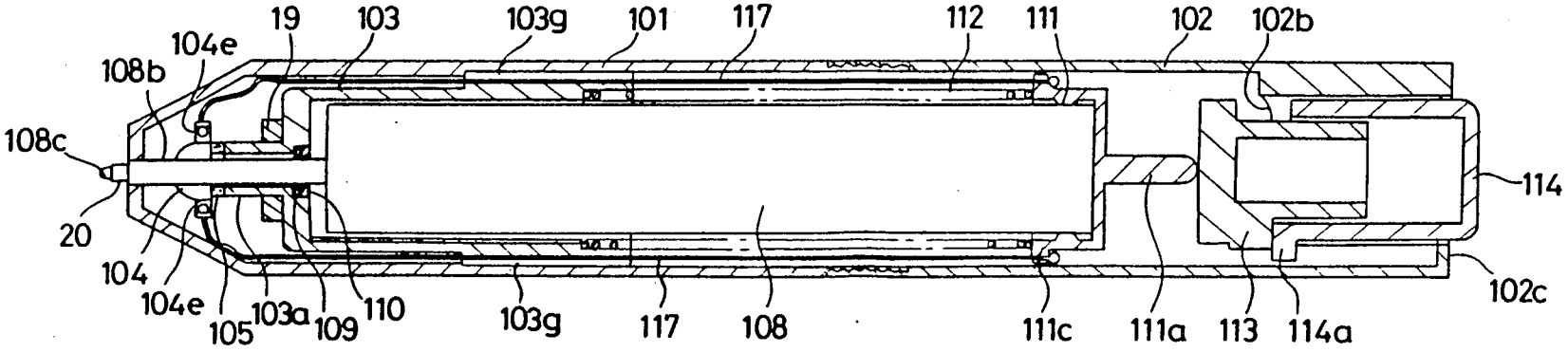
FIG. 21 shows the writing instrument of FIG. 20 which is ready for writing.

Now, a fourth embodiment of this invention will be described with reference to FIGS. 20 and 21, which correspond to FIGS. 14 and 18 of the third embodiment described above, respectively. More specifically. FIG. 20 shows the writing instrument which is in sealed state, and FIG. 21 shows the writing instrument which is ready for writing.

In the fourth embodiment, the wire-like members 117 and 117 are thin and flexible and have no frictional parts which provide frictional resistance against the writing member or the part operating in associated with writing member. The rear ends of the wire-like members 117 and 117 are fixedly secured to the flange 111*c* of the receiving member 111.

As was described above, the rear ends of the wire-like members 117 and 117 are secured to the flange 111*c* of the receiving member 111. Therefore, when the knocking member of the writing instrument whose state corresponds to that shown in FIG. 20 is pushed, the wire-like members 117 and 117 together with the receiving member 111 and the writing member 108 move forwardly. As a result, the seal cover 104 opens because the front ends of the wire-like members 117 and 117 have been fixedly coupled to the arms 104*e* and 104*e* of the seal cover 104. The seal cover 104 is light and is freely openably coupled to the end opening of the small diameter part 103*a* of the seal cylinder. Therefore, when, in the case where the writing instrument is held with its writing end toward the bottom, the wire-like members' force of pulling the seal cover to close the end opening of the small diameter part is eliminated, the seal cover 104 tends to open by its own weight. Accordingly, even a force of pushing the seal cover 104 with the front ends of the wire-like members 117 is small, it can open the seal cover 104. In the case where the writing instrument has a mechanism for moving the writing member back and forth by rotation, the writing member or the member operating in association with the writing member moves back and forth with the writing instrument held horizontal or with the writing instrument tilted in such a manner that the writing end is held at the top. Then when the writing member moves forwardly, a small force applied to the wire-like members 117 and 117 can open the seal cover 104.

When the knocking member 114 is further pushed, the flexible wire-like members 117 and 117 are bent in the writing instrument body, while the writing member 108 and the receiving member 111 move forwardly. Thus, the writing instrument is ready for writing as shown in FIG. 21.

When, under this condition, the knocking member 114 is depressed completely and released, the receiving member 111 and the writing member 108 move backwardly while the wire-like members 117 and 117 are straightened, so that the writing tip 108*c* of the writing member 108 retracts into the small diameter part 103*a* of the seal cylinder 103, and then the seal cover 104, being pulled by the wire-like members 117 and 117, is brought into the elastic member 105 bonded to the end face of the small diameter part 103*a* of the seal cylinder 103.

A fifth embodiment of the invention will be described with reference to FIGS. 22 through 25.

Figure 22:
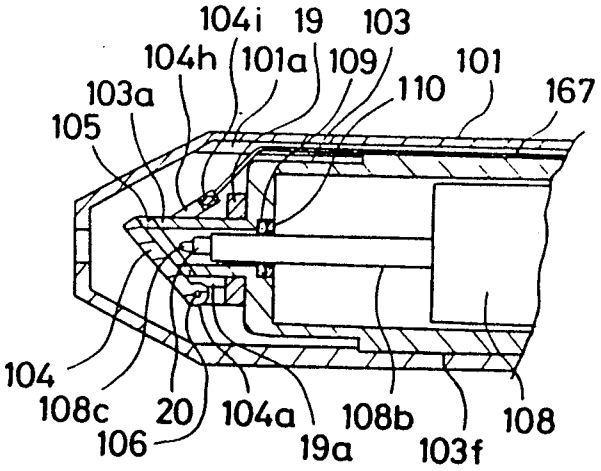
FIG. 22 is a sectional view showing essential components of the writing instrument of a fifth embodiment according to the invention, which is in seal state.
Figure 23:
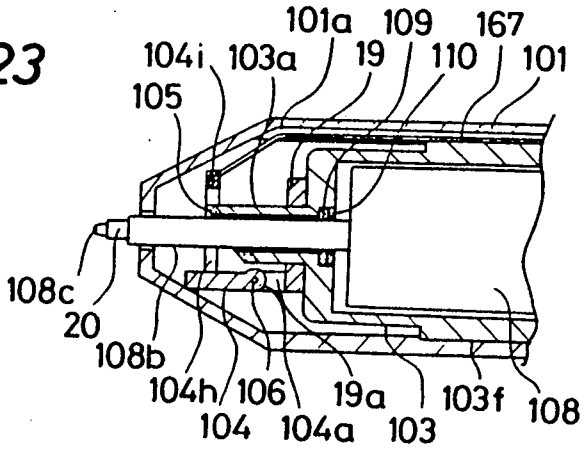
FIG. 23 is a sectional view showing the writing instrument of FIG. 22 which is ready for writing.
Figure 24:
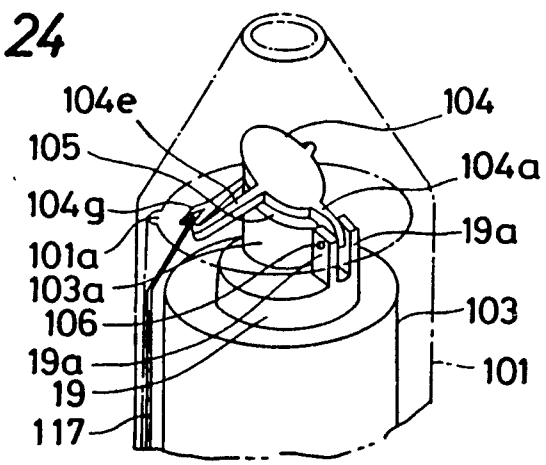
FIG. 24 is an enlarged perspective view showing essential components of the writing instrument shown in FIG. 22.

FIG. 22 is a sectional view showing the writing instrument which is in a sealed state. FIG. 23 is also a sectional view showing the writing instrument which is ready for writing. FIG. 24 is an enlarged perspective view showing essential components of the writing instrument shown in FIG. 22. FIG. 25 is also an enlarged perspective view showing essential components of the writing instrument shown in FIG. 23.

In the fifth embodiment, only one wire-like member 167 is used. The seal cover 104 has a U-shaped arm 104*h* which has a protrusion 104*i* at the middle. The front end of the wire-like member 167 engages a hole formed in the protrusion 104*i*. A groove 101*a* is formed in the front end portion of the front holder 101 in such a manner that it extends to the front end thereof. No grooves are formed in the large diameter parts 103*f* of the seal cylinder 103. The wire-like member 167 extends through the groove 101*a* formed in the front holder 101. The groove 101*a* is optional in length, in width and in configuration.

FIG. 26 shows a sixth embodiment of the invention in which the seal cover 154 is provided in the front holder by means of an arm 155*a* of an elastic member 155.

The annular part 155*b* of the elastic member 155 is held between the front end part 101*b* of the front holder 101 and the step formed in the inner wall of the front holder 101 with the front end part 101*b* secured to the front holder 101 by press-fitting or by using adhesive. The elastic member 155 has the aforementioned arm 155*a* which extends from a point on the annular part 155*b* towards the center. The elastic member 155 is large enough to cover the front end opening of the small diameter part 153*a* of the seal cylinder 153. The seal cover 154 is bonded to the rear surface of the elastic member 155. Two arms 154*e* and 154*e* extend from the elastic member 155 in such a manner that they form 90° with the arm 155*a*. The front ends of the wire-like members 117 and 117 engage with holes formed in the arms 154*e* and 154*e*, respectively.

Figure 26A:
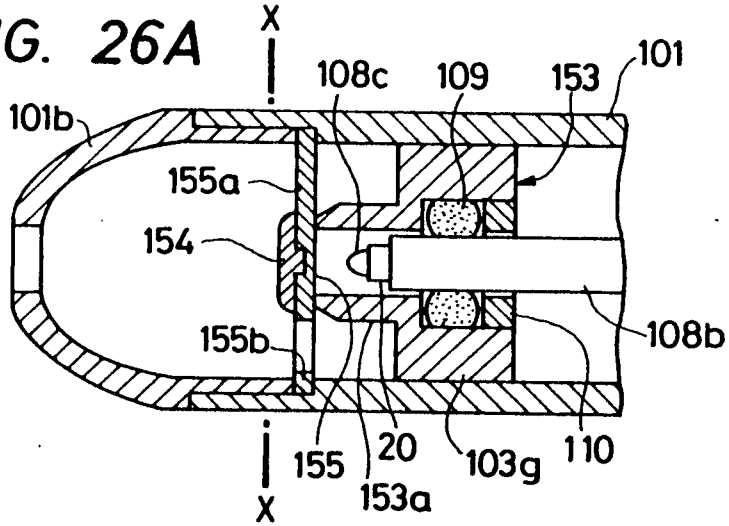
FIG. 26A is a sectional view of the writing instrument of a sixth embodiment according to the present invention.
Figure 26B:
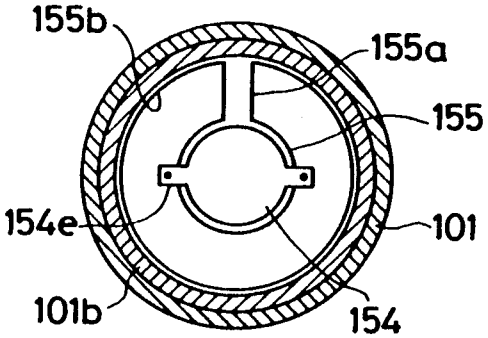
FIG. 26B is a sectional view taken along line X—X in FIG. 26A.

FIG. 26A is a sectional view of the writing instrument, and FIG. 26B is a sectional view taken along line X—X in FIG. 26A.

In the sixth embodiment, the seal cover 154 urged to close by a small force is pushed and opened with the front ends of the wire-like members 117 and 117, and thereafter, the writing tip 8*c* protrudes out of the front end hole of the front end part 101*b*.

Figure 27:
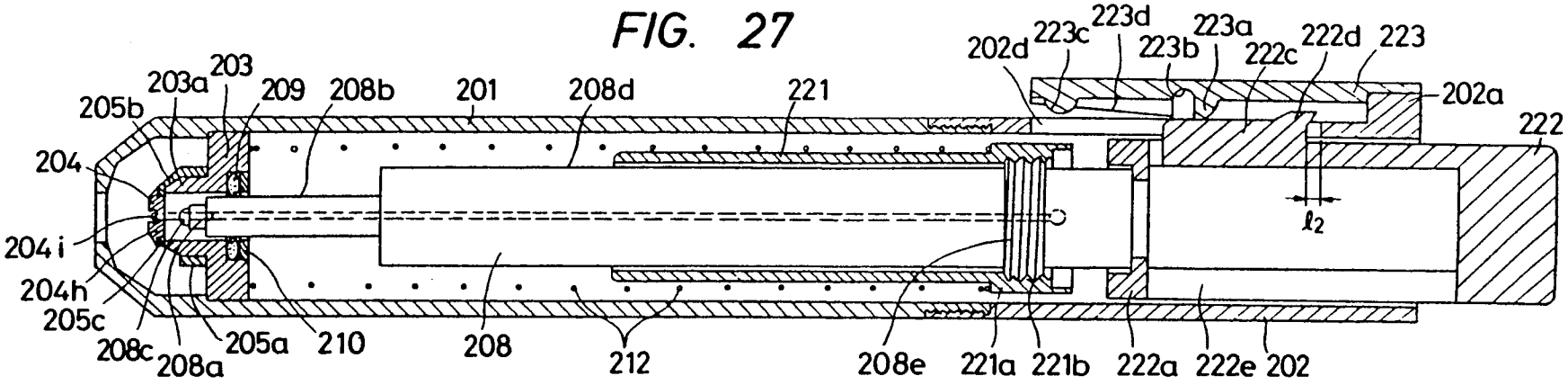
FIG. 27 is a sectional plan view of a seventh embodiment of a writing instrument according to the present invention.
Figure 28:
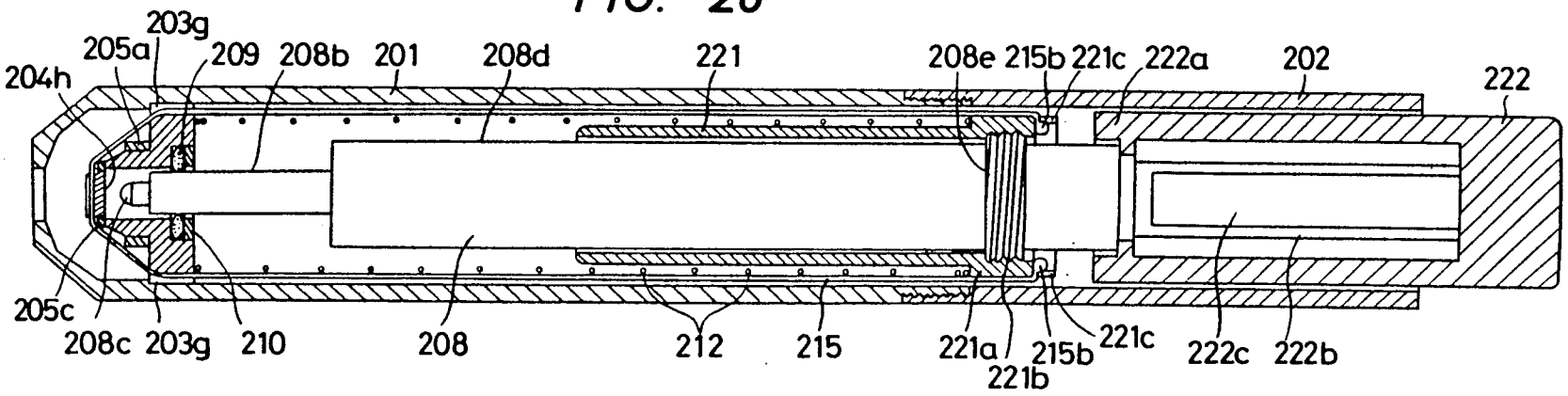
FIG. 28 is a sectional side view of FIG. 27.

A seventh embodiment of the invention will be described with reference to FIGS. 27 and 28. FIG. 27 is a sectional plan view showing the writing instrument into which the writing member has been retracted. FIG. 28 is a sectional side view of the writing instrument shown in FIG. 27.

Figure 33:
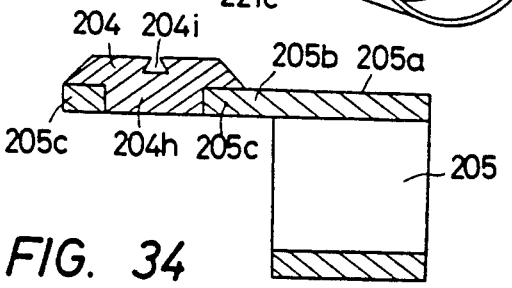
FIG. 33 is an enlarged sectional view of a sealing member with a seal cover shown in FIG. 27.
Figure 34:
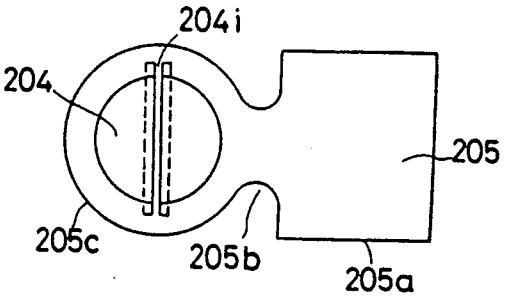
FIG. 34 is the sealing member of FIG. 33 shown from the upper side.

A seal cylinder 203 having grooves 203*g* and 203*g*, through which thread-like members 15 and 15 pass, is provided in the front end portion of the front holder 201. The front end portion of the seal cylinder 203 is formed into a small diameter part 203*a*, the front end portion of which is tapered. An elastic member 205 has a cover part 205*c* which is annular and rises by itself. The cylindrical part 205*a* of the elastic member 205 is fixedly fitted on the small diameter part 203*a* of the seal cylinder 203. The cylindrical part 205*a* is connected through a hinge part 205*b* to the cover part 205*c* as shown in FIG. 34. A seal member (O-ring) 209 is provided in the seal cylindrical 203 and is retained there by means of a retaining ring 210, in such a manner that the O-ring 209 is maintained elastically abutted against the small diameter part 208*b* of the writing member (refill unit). An air hole 208*a* is provided between the front end portion of the small diameter part of the writing member and the writing tip 208*c*. A seal cover 204 has a circular protrusion 204*h*, which engages with the annular cover part 205*c* of the elastic member 205. A groove 204*i* whose inlet is slightly smaller than its width is formed in the outer (or top) surface of the seal cover 204, as shown in FIG. 33.

A hollow cylindrical 221 is disposed on the large diameter part of the refill unit 208. The rear end portion of the cylinder 221 is formed into a large diameter part 221*a*, the inner wall of which is female-threaded as indicated at 221*b*. The cylinder 221 has grooves 221*c* and 221*c* at the rear end. A retracting spring 212 is interposed between the seal cylinder 203 and the hollow cylinder 221 to urge the latter 221 backwardly. The refill unit 208 has a male-threaded part 208*e* which engages with the female-threaded part 221*b* of the cylinder 221 so that the refill unit 208 is integral with the cylinder 221. That is, all that is required for the refill unit 208 and the cylinder is that the refill unit and the cylinder operate in association with each other. That is, as the refill unit moves forwardly, the cylinder 221 moves forwardly, and as the cylinder 221 moves backwardly, the refill unit moves backwardly. A protrusion may be formed on the outer wall of the cylinder 221 while a groove for receiving the protrusion may be formed in the front holder so that the cylinder 221 moves straightly back and forth without turning in the front holder 201.

Figure 32:
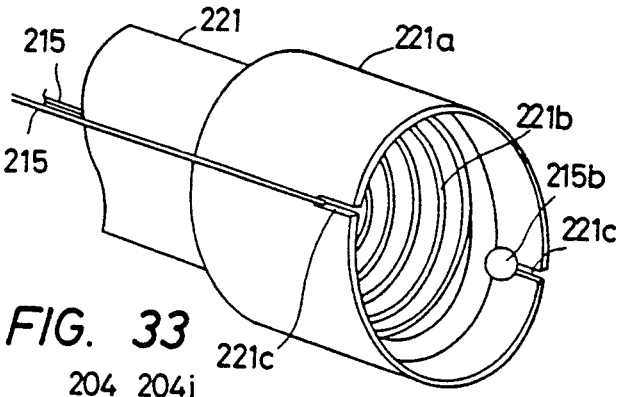
FIG. 32 is an enlarged perspective view showing a rear end of a cylinder of FIG. 27.

Knots 215*b* and 215*b* are formed at both ends of a thread-like member 215, respectively. The knots 215*b* and 215*b* engage with the grooves 221*c* formed at the rear end of the cylinder. The middle of the thread-like member 215 engages with the groove 204*i* formed in the outer surface of the seal cover 204. Thus, the seal cover 204 has been coupled to the cylinder through the thread-like member 215 (cf. FIG. 32).

Figure 29:
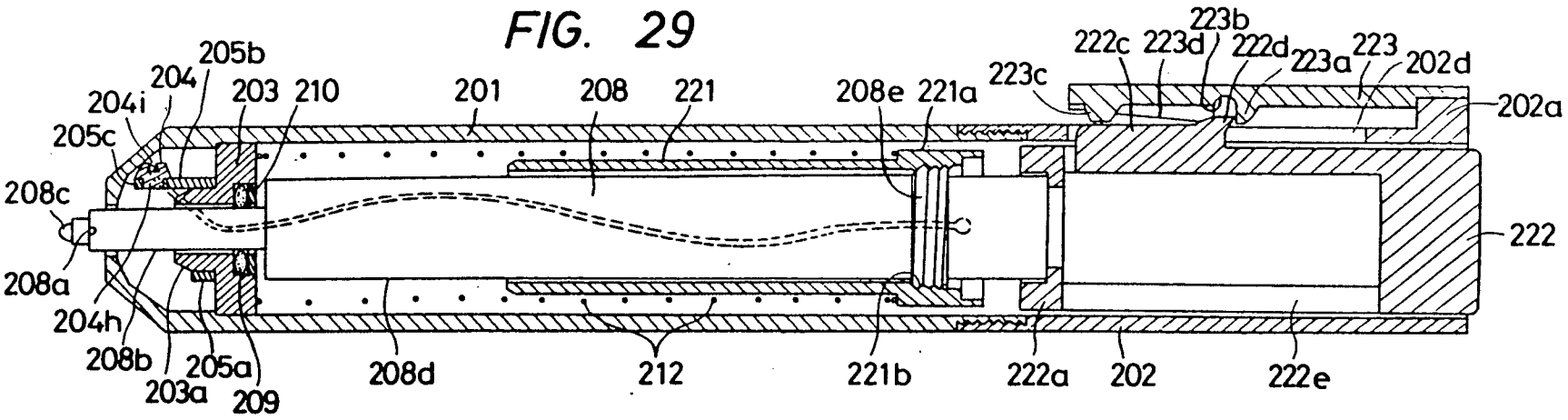
FIGS. 29 and 30 show the writing instrument which is made ready for writing with a knocking member depressed when the writing instrument is held as shown in FIGS. 27 and 28, respectively.
Figure 30:
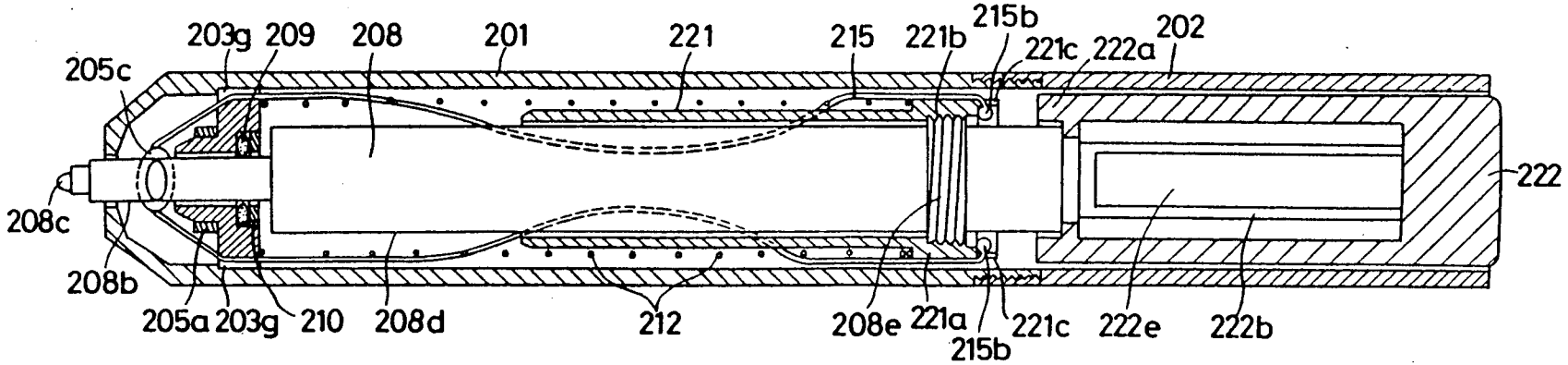
Figure 31:
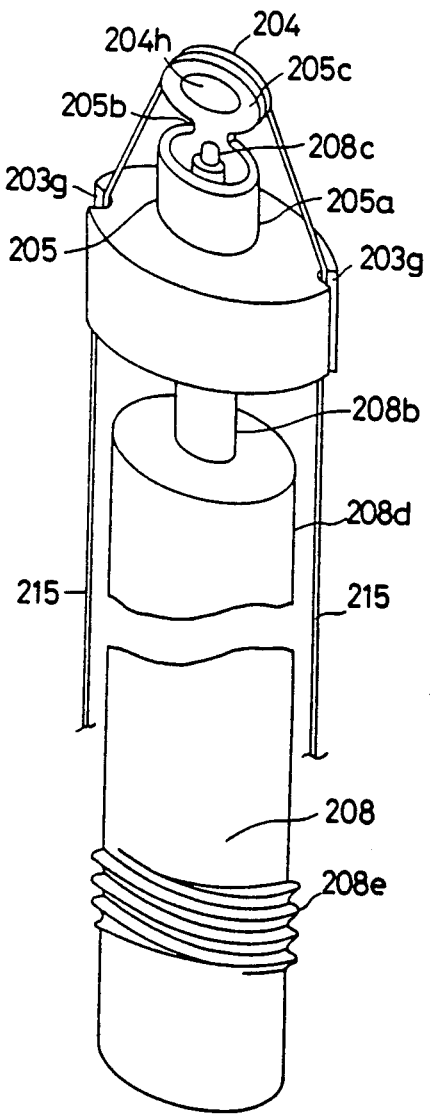
FIG. 31 is an enlarged perspective view showing essential components of the writing instrument shown in FIG. 27.
Figure 35:
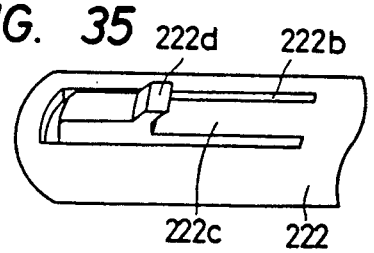
FIG. 35 is an enlarged perspective view showing a knocking member of FIG. 27.

FIGS. 29 and 30 show the writing instrument which is ready for writing with the knocking member 222 depressed when the writing instrument is held as shown in FIGS. 27 and 28. In this embodiment, the knocking member 222 is provided with a tongue piece 222*c*, a slit 222*b* and a protrusion 222*d* as shown in FIG. 35. As the knocking member 222 is pushed forwardly, the protrusion 222*d* formed on the tongue piece 222*c* moves forwardly along the slit 202*b* formed in the rear holder 202 so that it is locked by a locking part provided on the inner surface of a clip 223. After the elastic member's cover part 205*c* is opened together with the seal cover 204, the thread-like member 215 slackens inside the writing instrument body, and the writing member 208 and the cylinder operating in association with the writing member 208 move forwardly.

Now, the writing instrument is ready for writing. Thereafter, the front end portion of the clip 223 is depressed inwardly. As a result, a depressing part 223*c*, smaller in width than the slit 202*d* of the rear holder, is moved inwardly with the aid of a hinge part 223*b* of the clip 223 to move down the tongue piece 222*c*. At the same time. the protrusion 222*d* locked by the locking part 223*a* of the clip 223 also moves downwardly; that is, it disengages from the locking part 223*a*. As a result, the retracting spring 212 moves the cylinder 221 and the writing member 208 backwardly. Thus, the writing instrument has been restored as shown in FIGS. 27 and 28. In this case, a small gap is formed between the protrusion 222*d* and the rear end of the slit 202*d*, to improve the sealing characteristic and to absorb the slight elongation of the thread-like member 215.

Figure 36:
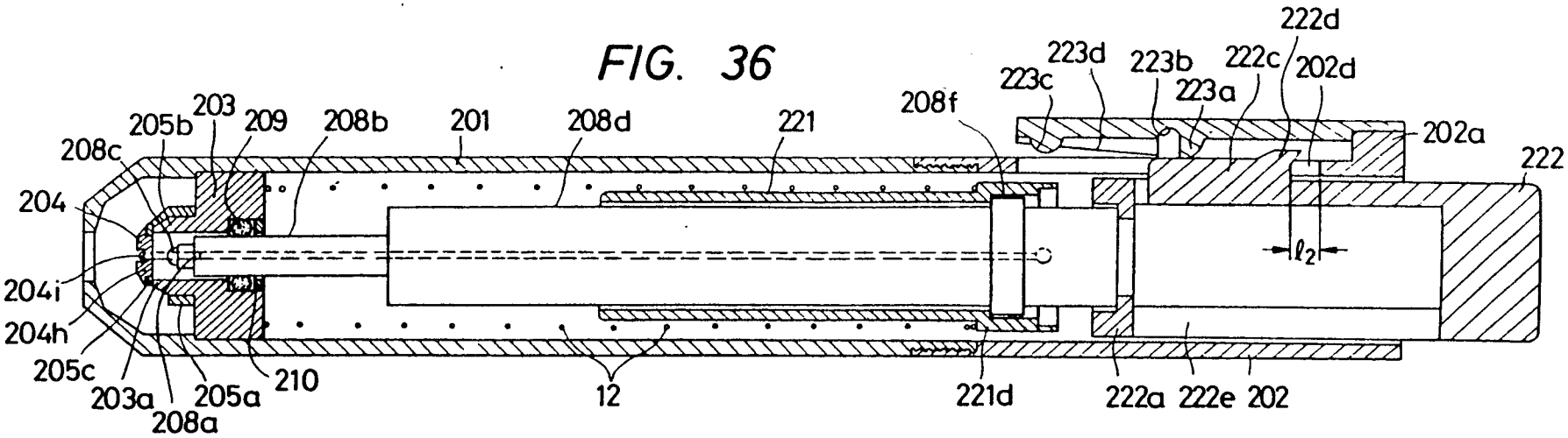
FIG. 36 is a sectional plan view of a eighth embodiment of a writing instrument according to the present invention.
Figure 37:
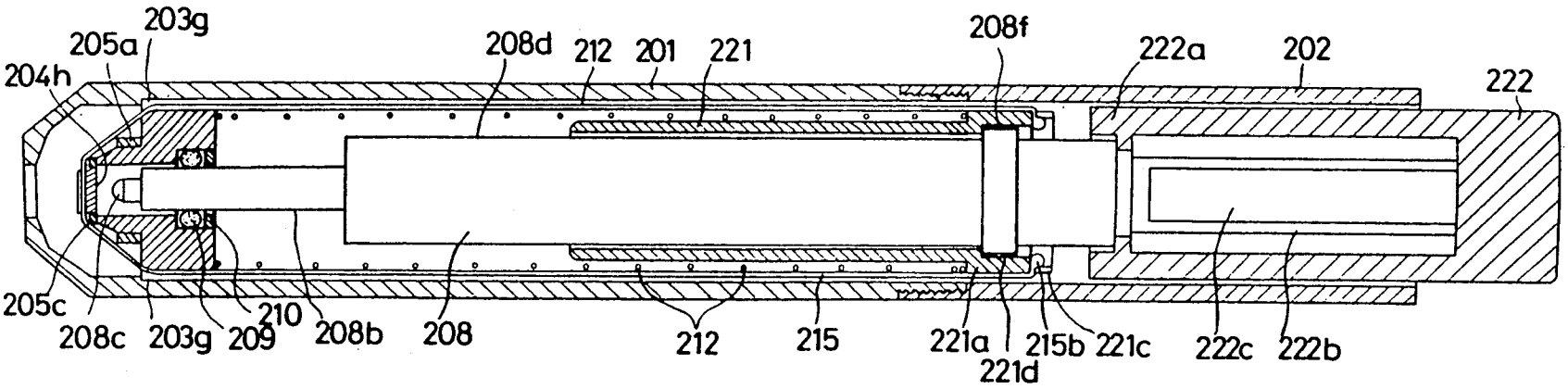
FIG. 37 is a sectional side view of FIG. 36.

An eighth embodiment of the invention will be described with reference to FIGS. 36 and 37.

The eighth embodiment is different from the seventh embodiment in that the inner wall of the cylinder 221 is not threaded, and the cylinder 221 has a step 221*d*, while the writing member 208 has a flange part 208*f* instead of the male-threaded part. In the eighth embodiment, the flange part 208*f* of the writing member abuts against the step 221*d* formed inside the cylinder 221, and the writing member's small diameter part 208*b* is elastically held by a sealing member 209.

Figure 38:
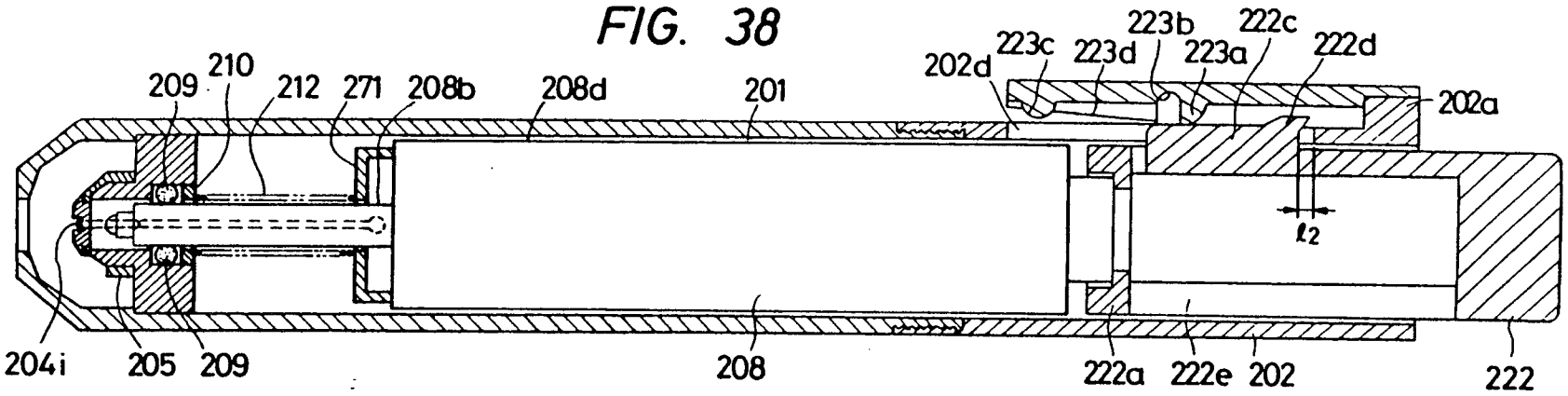
FIG. 38 is a sectional plan view of a ninth embodiment of a writing instrument according to the present invention.
Figure 39:
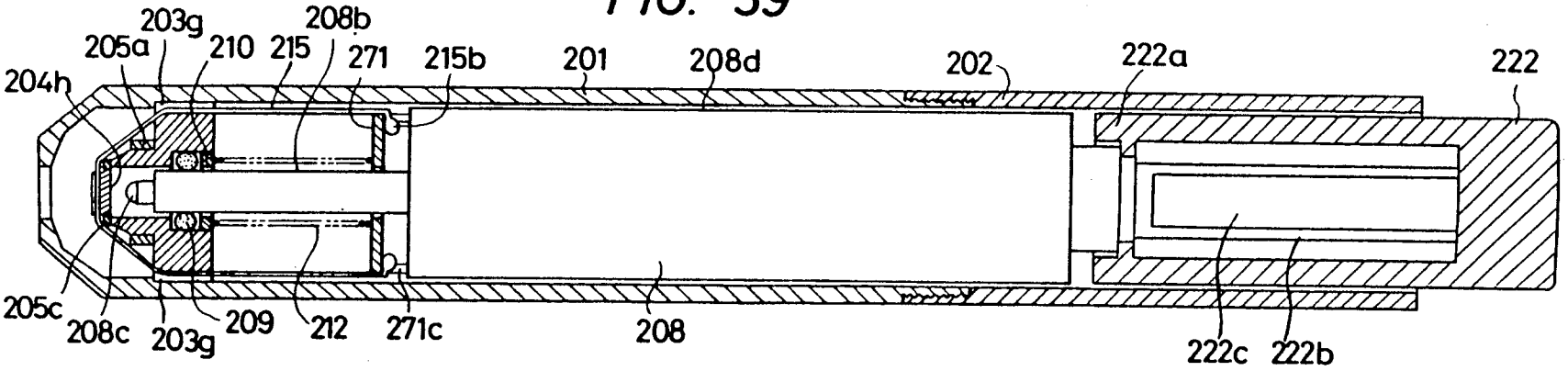
FIG. 39 is a sectional side view of FIG. 38.
Figure 42A:
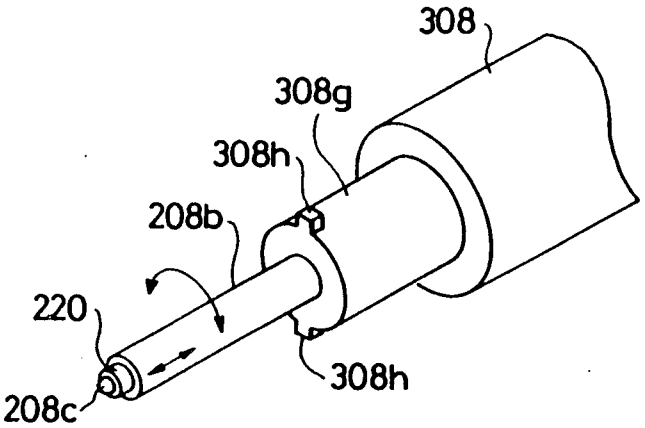
FIG. 42A is an enlarged perspective view showing a front side of a writing member shown in FIG. 40.
Figure 42B:
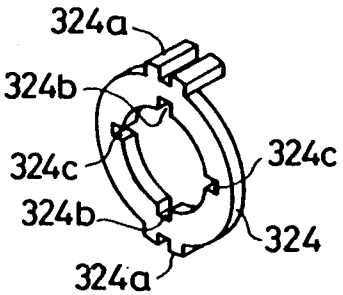
FIG. 42B is an enlarged perspective view showing a coupling ring shown in FIG. 40.

FIGS. 38 and 39 show a ninth embodiment of the invention which is in seal state.

The ninth embodiment is different from the eighth embodiment in that cylinder 271 is in the form of an inverted-U-shaped short ring having a hole at the center into which the small diameter part 208*b* of the writing member 208 is inserted and having a rear end with grooves 271*c* abutting against the front end face of the large diameter part 208*d* of the writing member 208.

In both the eighth and ninth embodiments, when the writing member retracts into the writing instrument body, sometimes the writing member 208 may be shifted rearwardly of the position illustrated by the elastic force of the retracting spring 212. In this case, a gap $l_2$ is not formed between the protrusion 222*d* of the knocking member 222 and the rear end of the slit 202*d* of the rear holder 202, and instead it is formed between the rear end of the cylinder 221 and 271 and the front end face of the large diameter part 208*d* of the writing member 208. Accordingly, the distance between the air hole 208*a* formed near the end of the writing member's small diameter part 208*b* and the sealing member 209 should be sufficiently long so that the position of the air hole 208*a* does not move to rear side of the sealing member 209 even when the writing member 208 moves slightly over the predetermined position in the backward direction.

A tenth embodiment of the invention will be described with reference to FIGS. 40 through 44.

Figure 40:
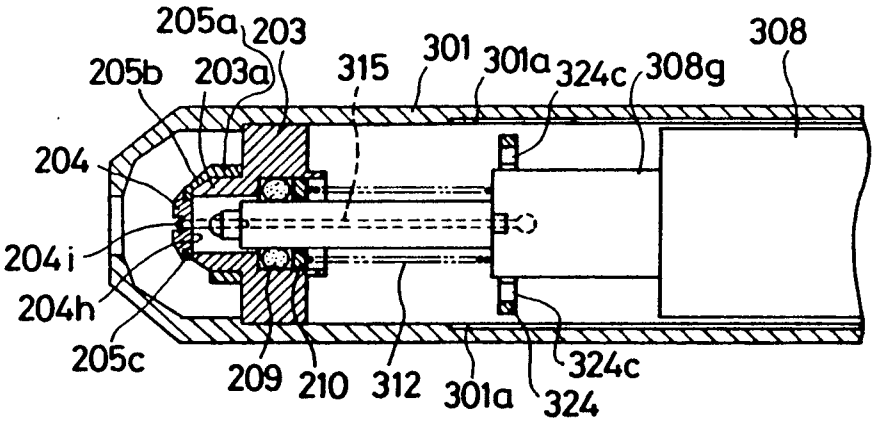
FIG. 40 is an essential sectional plan view of a tenth embodiment of a writing instrument according to the present invention.
Figure 41:
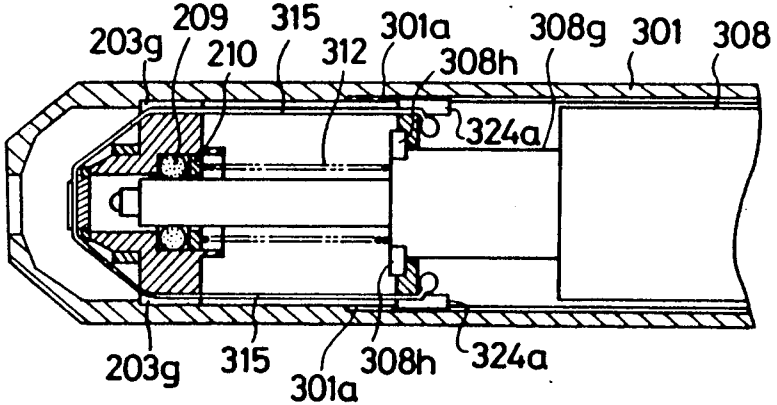
FIG. 41 is a sectional side view of FIG. 40.
Figure 43:
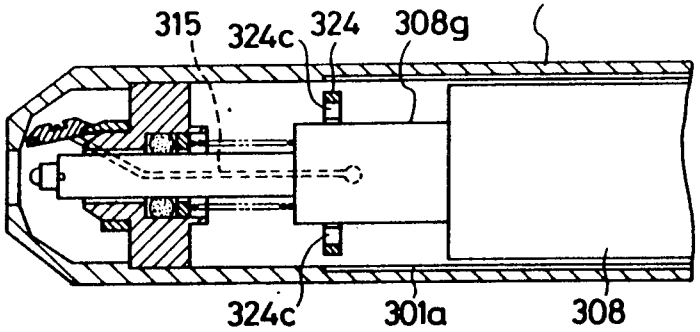
FIGS. 43 and 44 show the writing instrument in which, when the writing instrument is held as shown in FIGS. 40 and 41, respectively.
Figure 44:
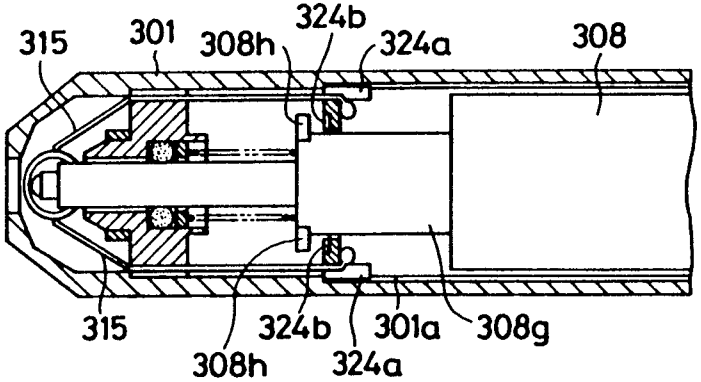

FIGS. 40 and 41 show the writing instrument which is in sealed state. FIGS. 43 and 44 show the writing instrument in which the writing members slightly moves in the forward direction.

In the tenth embodiment, the rear end of a retracting spring 312 abuts against the front end face of the middle diameter part 308*g* of the writing member 308. Protrusions 308*h* and 308*h* are provided on the periphery of the front end face of the middle diameter part 308*g* at angular intervals of 180°. On the other hand, protrusions 324*a* and 324*a* having grooves, to which the thread-like member is secured, are provided on the outer periphery of a coupling ring 324 at angular intervals of 180°, and recesses 324*b* and 324*b* are formed in the inner peripheral portion of the coupling ring 324 in such a manner that the recesses 324*b* and 324*b* and the protrusions 324*a* and 324 are in a line. Furthermore, cuts 324*c* and 324*c* are formed in the inner peripheral portion of the coupling ring 324 in such a manner that the cuts 324*c* and the recesses 324*b* are arranged at angular intervals of 90° (cf. FIGS. 42A and 42B). The coupling ring 324 moves back and forth with the protrusions 324*a* and 324*a* maintained engaged with the grooves 301*a* and 301*a* of the front holder 301.

In the case of the FIGS. 40 and 41, the protrusions 308*h* and 308*h* of the middle diameter part of the writing member are inserted into the recesses 324*b* and 324*b* of the coupling ring 324, respectively, to which both ends of the thread-like member 315 are tied, and the writing member 308 is pushed backwardly by the retracting spring 312. The coupling ring 324 cannot move backwardly any further because the thread-like member 315 has been stretched tight. In FIGS. 40 and 41, like parts and components are designated by the same reference numerals as that shown in FIG. 27.

FIGS. 43 and 44 show the writing instrument in which, when the writing instrument is held as shown in FIGS. 40 and 41, the retracting spring 312 is compressed to move the writing member slightly in the forward direction to interchange the writing member for a new one.

As protrusions 324*a* and 324*a* abut against the front ends of the grooves 301*a* and 301*a* formed in the front holder 301, the coupling ring 324 cannot move forwardly anymore. On the other hand, the writing member 308 moves forwardly farther than the coupling ring 324, as a result of which the protrusions 308*h* and 308*h* provided at the front end of the middle diameter part 308*g* disengage from (pulled out of) the recesses 324*b* and 324*b* of the coupling ring 324, respectively. Under this condition, the writing member 308 is turned through 90° so that the protrusions 308*h* and 308*h* of the small diameter part of the writing member align with the cuts 324*c* and 324*c* of the coupling ring 324, respectively. Therefore, the writing member 308 can be pulled backwardly; that is, it can be removed from the writing instrument body. The above-described operations are carried out in the reverse order to load a new writing member into the writing instrument body. That is, the protrusions 308*h* and 308*h* of the new writing member 308 engage with the cuts 324*c* and 324*c* of the coupling ring 324, and the writing member is turned through 90° and then released. As a result, the writing member 308 is moved backwardly by the elastic force of the retracting spring 312 and with the protrusions 308*h* and 308*h* engaging with the recesses 324*b* and 324*b* the coupling ring 324 moves backwardly until the thread-like member 315 is stretched tight.

The coupling ring 324 moves back and forth with the protrusions 324*a* and 324 maintained engaged with the grooves 301*a* and 301*a* of the front holder 301, and therefore, it will not be turned when the writing member 308 is interchanged for a new one.

When the writing instrument, held as shown in FIGS. 40 and 41, is prepared for writing by further moving the writing member 308 forwardly, the thread-like member 315 slackens in the front holder 301.

An eleventh embodiment of the invention will be described with reference to FIGS. 45 and 46.

In the eleventh embodiment, the rear ends of the thread-like member 415 is connected to the front end of the knocking member 422. That is, the writing instrument is so designed that the knocking member moves back and forth without turning, which makes it possible to connect the rear ends of the thread-like member 415 to the front end of the knocking member 422.

Figure 45:
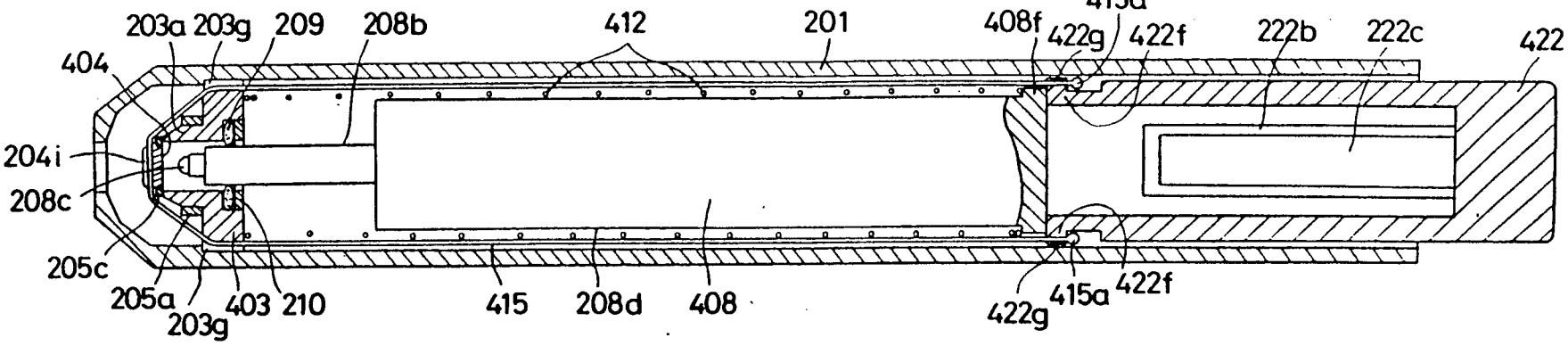
FIG. 45 is a sectional side view of an eleventh embodiment of a writing instrument according to the present invention.
Figure 46:
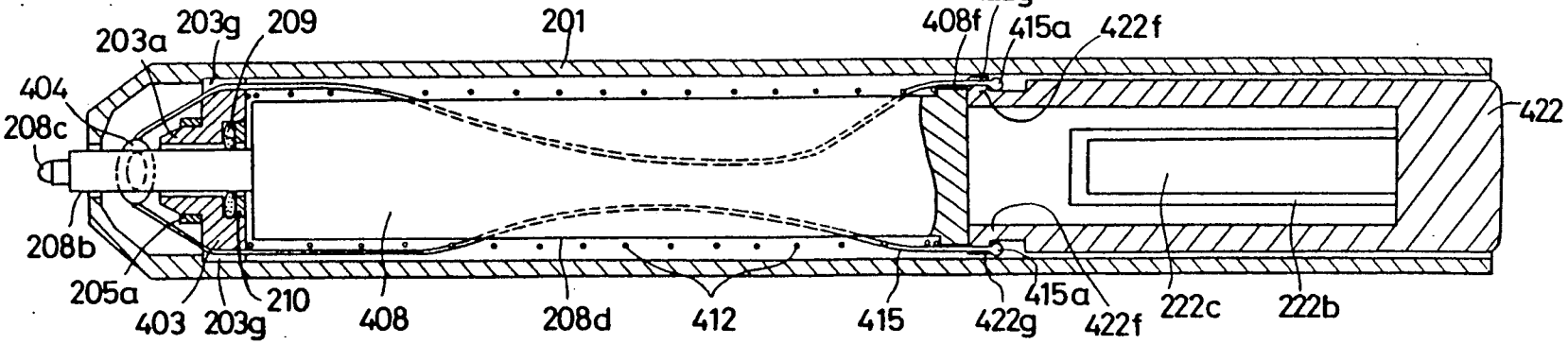
FIG. 46 shows the writing instrument of FIG. 45 which is ready for writing.

FIG. 45 shows the writing instrument with the writing member retracted into the writing instrument body, and FIG. 46 shows the writing instrument which is ready for writing.

The knocking member 422 has two protrusions 422*f* and 422*f* at the front end, which have narrow grooves 422*g* and 422*g*, respectively. The writing member 408 is provided with a flange 408*f* at the rear end thereof. A retracting spring 412 is interposed between the flange 408*f* of the writing member 408 and the seal cylinder 403, so that, under the condition that the rear end of the writing member abuts against the front end of the knocking member 422 and the retracting spring 412 is slightly compressed, the seal cover 404 is coupled through the thread-like member 415 to the knocking member 422. The connection between the thread-like member 415 and the sealing member 404 is the same as that of the seventh embodiment described above. The rear ends of the thread-like member 415 are fixedly fastened to the protrusions 422*f* and 422*f* of the knocking member 422.

Figure 47:
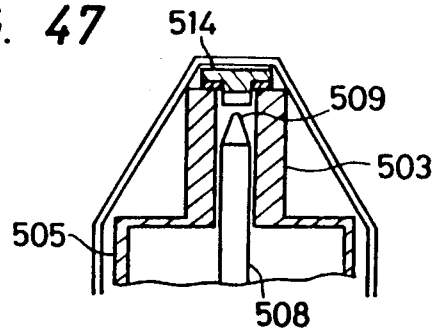
FIG. 47 is a sectional view of an essential part of an arrangement of the writing instrument according to the invention.

The rear ends of the thread-like member may be fixedly connected directly to the protrusions or flange of the writing member so that the rear portion of the writing member acts as a knocking member, or to any other parts of the mechanism moving the knocking member back and forth. In FIGS. 46 and 47, like parts and components are designated by the same reference numerals as that shown in FIG. 27.

Figure 48:
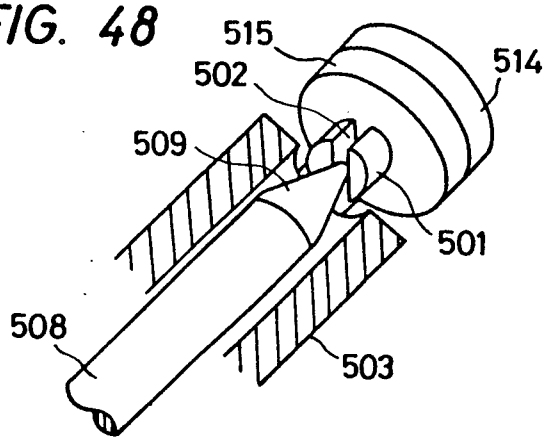
FIG. 48 is an enlarged perspective view of FIG. 47.

FIG. 47 is a sectional view of an essential part of an arrangement of the invention. FIG. 48 is an enlarged perspective view of FIG. 47.

In this arrangement, a convex member 501 is disposed on the rear face of a seal cover 514 having an annular elastic member 515 at the rear side thereof. The diameter of the protrusion is smaller than that of the opening of the seal member 503. A writing tip 509 of a writing member 508 has a tapered face. The convex member 501 is provided wit a slit 502. The width of the slit 502 is larger than the smallest part and smaller than the largest part of the tapered face of the writing tip 509 so that the slit 502 receives the tapered face of the writing tip 509. The depth of the slit is deeper than the length between an end of the writing tip 509 and a part on the tapered face which contacts with edges of the slit so that the end of the writing tip does not contact to a bottom of the slit. In FIGS. 47 and 48, the convex member is cylinder-shaped. However, it is not limited thereto. For example, the convex member may be hemispher-shaped or rectangular pole or the like.

While several embodiments of the invention have been described, the invention is not limited thereto or thereby. For instance, the mechanism for moving the writing member back and forth may be of the rotary type or of the knock type. Furthermore, the writing instrument may employ a variety of means for urging the seal cover to open. Furthermore, some of the components may be formed as one unit, and the materials and configurations of the components are not limited to those which have been described above. That is, various changes in design and modifications may be made in the above-described embodiments without departing from the invention.

As is apparent from the above description, the writing instrument according to the invention provides the following effects:

The writing instrument can be used at ease since it has no cap. The writing instrument is reliably sealed in the writing instrument body so that the writing instrument can be provided on market while the writing member is accommodated in the writing instrument body. The writing instrument is simple in construction and small in the number of components and, thus, can be readily manufactured at low cost. The present invention is suitable as a disposable or as a refill interchangeable writing instrument. The writing instrument is standard in configuration. Therefore, a writing instrument excellent in design can be formed. If the invention is applied to a knock type writing instrument, an elastic sealing member is always urged to the writing member when the writing member retracts into the body by a retracting spring. Accordingly, cotton or lead contained in the writing member would not slip with respect to the writing member, since a shock due to the retracting operation of the writing member is softened.

What is claimed is:

1. A writing instrument comprising:

a hollow body;

writing means for writing, said writing means having a writing tip and a writing member, said writing means being accommodated in said hollow body;

means for sealing said writing tip, said sealing means including a seal cylinder provided with an opening at a front end thereof, a cover means for sealing said opening of said seal cylinder when said writing means is retracted, and a seal member provided between said seal cylinder and said writing means, said seal member always abutting against said writing means;

moving means for moving said writing means, said moving means being provided between said writing means and said body for moving said writing means forwardly thereby causing said cover means to open, for locking said writing means at a writing position and for moving said writing means backwardly to retract said writing means so as to seal said writing tip; and means for continuously connecting said writing means to said cover means of said sealing means, said continuously connecting means being provided at an outside of a portion of said seal member, which portion abuts against said writing means, said connecting means having an end portion directly fixed to said writing means by an element attached to said writing member, said connecting means being an elongate thread-like connecting member, said connecting means allowing said writing means to move forwardly, and said connecting means closing said cover means to seal said opening of said seal cylinder after said writing tip of said writing means retracts into said seal cylinder.

2. The writing instrument of claim 1, further comprising means for guiding said connecting means from said seal member to said writing means.

3. The writing instrument of claim 2, wherein said guiding means comprises at least one of a through-hole and a groove provided at a portion of said seal cylinder which contacts against said body.

4. The writing instrument of claim 2, wherein said guiding means comprises at least one groove provided at a portion of said body which contacts against said seal cylinder.

5. The writing instrument of claim 1, wherein said cover means is provided on a front portion of said seal cylinder.

6. The writing instrument of claim 1, wherein said writing means comprises said writing member and a coupling member operatively connected to said writing member.

7. The writing instrument of claim 6, wherein said coupling member operably connected to said writing member is detachably coupled to said writing member.

8. The writing instrument of claim 1, wherein an end of said connecting means is connected to one of a step and a protrusion of said writing means.

9. The writing instrument of claim 1, wherein said connecting means connects said cover means to said writing means moving means.

10. The writing instrument of claim 1, wherein said cover means has a groove which receives said connecting means.

11. The writing instrument of claim 1, wherein said cover means has a through-hole through which said connecting means passes.

12. The writing instrument of claim 1, wherein said cover means and said seal cylinder are unitary formed.

13. The writing instrument of claim 1, wherein said cover means is always urged to open said opening of said seal cylinder.

14. The writing instrument of claim 1, wherein said cover means has a self-opening force.

15. The writing instrument of claim 1, wherein said cover means is free-openable.

16. The writing instrument of claim 1, further comprising an elastic member provided at a rear face of said cover means.

17. The writing instrument of claim 1, further comprising an elastic member provided at a front end of said seal cylinder.

18. The writing instrument of claim 1, further comprising a convex member and an annular elastic member provided at a rear face of said cover means.

19. The writing instrument of claim 18, wherein said writing tip of said writing means has a tapered face, and said convex member is provided with a slit the depth of which is longer than a distance between an end of said writing tip and a portion of said tapered face which contacts with the edges of said slit.

20. The writing instrument of claim 1, further comprising a retracting spring provided between said writing means and said body.

21. The writing instrument of claim 1, further comprising a retracting spring provided between said writing means and said seal cylinder.

22. The writing instrument of claim. 1, further comprising a retaining ring fitted to said seal cylinder at a rear side of said seal member.

23. The writing instrument of claim 1, wherein said writing means moving means is of the knock type.

24. The writing instrument of claim 6, wherein said writing means moving means is of the rotary type.

25. The writing instrument of claim 1, wherein said writing means is interchangeable in said body.

* * * * *